US011458594B2

(12) United States Patent
Nakamura

(10) Patent No.: US 11,458,594 B2
(45) Date of Patent: Oct. 4, 2022

(54) METHOD FOR MANUFACTURING CUTTING BLADE, AND CUTTING BLADE

(71) Applicant: TOKYO SEIMITSU CO., LTD., Hachioji (JP)

(72) Inventor: Masato Nakamura, Tokyo (JP)

(73) Assignee: TOKYO SEIMITSU CO., LTD., Tokyo (JP)

( * ) Notice: Subject to any disclaimer, the term of this patent is extended or adjusted under 35 U.S.C. 154(b) by 271 days.

(21) Appl. No.: 16/719,646

(22) Filed: Dec. 18, 2019

(65) Prior Publication Data

US 2020/0122297 A1 Apr. 23, 2020

Related U.S. Application Data

(60) Division of application No. 15/982,959, filed on May 17, 2018, now abandoned, which is a continuation of (Continued)

(30) Foreign Application Priority Data

Dec. 21, 2015 (JP) ..... JP2015-248991

(51) Int. Cl.
*B24D 18/00* (2006.01)
*B24D 3/32* (2006.01)

(Continued)

(52) U.S. Cl.
CPC ..... *B24D 3/32* (2013.01); *B24D 3/00* (2013.01); *B24D 3/02* (2013.01); *B24D 3/06* (2013.01);

(Continued)

(58) Field of Classification Search
CPC ..... B24B 37/044; B24B 37/24; B24D 3/32; B24D 3/00; B24D 3/02; B24D 3/06; B24D 3/344; B24D 18/0009; B24D 5/12
See application file for complete search history.

(56) References Cited

U.S. PATENT DOCUMENTS 3,524,286 A ‡ 8/1970 Wohrer ..... B24D 3/344 51/298
5,313,742 A * 5/1994 Corcoran, Jr. ..... B24D 5/12 51/306

(Continued)

FOREIGN PATENT DOCUMENTS

JP 54-010751 B2 ‡ 5/1979
JP 54-010751 B2 5/1979

(Continued)

OTHER PUBLICATIONS

International Preliminary Report on Patentablility for related PCT application No. PCT/JP2016/087906, dated Sep. 6, 2017 by the Japanese patent office; English translation provided; 13 pages.‡

(Continued)

*Primary Examiner* — Pegah Parvini
(74) *Attorney, Agent, or Firm* — Procopio, Cory, Hargreaves & Savitch LLP

(57) ABSTRACT

This method for manufacturing a cutting blade includes: a mixing step of adding a liquid dispersion medium to a mixed powder containing a resin powder of a thermocompression-bondable resin, abrasive grains and fibrous fillers; a compression step of cold pressing, in a forming die, the mixed powder to which the dispersion medium has been added to form an original plate of a blade main body; and a sintering step of hot pressing and sintering the original plate.

2 Claims, 7 Drawing Sheets

Related U.S. Application Data application No. PCT/JP2016/087906, filed on Dec. 20, 2016.

(51) Int. Cl.

| | |
|---|---|
| ***B24D 5/12*** | (2006.01) |
| ***B24D 3/02*** | (2006.01) |
| ***B24D 3/00*** | (2006.01) |
| ***B24D 3/34*** | (2006.01) |
| ***B24D 3/06*** | (2006.01) |

(52) U.S. Cl.

CPC ..... *B24D 3/344* (2013.01); *B24D 5/12* (2013.01); *B24D 18/0009* (2013.01)

(56) References Cited

U.S. PATENT DOCUMENTS

| | | | | | |
|---|---|---|---|---|---|
| 6,012,977 | A ‡ | 1/2000 | Yoshikawa | ..... | B24D 5/12 125/15 |
| 2009/0283718 | A1* | 11/2009 | Yao | ..... | C09K 5/10 977/773 |
| 2010/0206337 | A1* | 8/2010 | Hiroshiro | ..... | H01L 21/67034 134/26 |

FOREIGN PATENT DOCUMENTS

| | | | | | |
|---|---|---|---|---|---|
| JP | 61-173863 | A ‡ | 8/1986 | ..... | B24D 3/30 |
| JP | 61-173863 | A | 8/1986 | | |
| JP | 10-193267 | A ‡ | 7/1998 | | |
| JP | 10-193268 | A ‡ | 7/1998 | | |
| JP | H10-193267 | A | 7/1998 | | |
| JP | H10-193268 | A | 7/1998 | | |
| JP | 2015-098070 | * | 11/2013 | ..... | B24D 5/12 |
| JP | 2014-524358 | A | 9/2014 | | |
| JP | 2014-524358 | A ‡ | 9/2014 | | |
| JP | 2015-098070 | A ‡ | 5/2015 | | |
| JP | 2015-098070 | A | 5/2015 | | |
| WO | 2013/028945 | A1 | 2/2013 | | |
| WO | WO-2013/028945 | A1 ‡ | 2/2013 | ..... | B24D 3/342 |

OTHER PUBLICATIONS

International Search Report for related PCT application No. PCT/JP2016/087906, dated Feb. 28, 2017; English translation provided; 7 pages.‡

International Search Report for related International Application No. PCT/JP2016/087906, dated Feb. 28, 2017; English translation provided; 7 pages.

International Preliminary Report on Patentablility for related International Application No. PCT/JP2016/087906, dated Sep. 6, 2017 by the Japanese patent office; English translation provided; 13 pages.

Non-Final Rejection for U.S. Appl. No. 15/982,959, dated Apr. 25, 2019; 21 pages.

Final Rejection for U.S. Appl. No. 15/982,959, dated Aug. 20, 2019; 12 pages.

* cited by examiner

‡ imported from a related application

METHOD FOR MANUFACTURING CUTTING BLADE, AND CUTTING BLADE

The present application is a divisional application of U.S. application Ser. No. 15/982,959, filed May 17, 2018, which in turn is a continuation of International Application No. PCT/JP2016/087906, filed on Dec. 20, 2016, which claims priority to Japanese Patent Application No. 2015-248991 filed on Dec. 21, 2015, the content of which is incorporated herein by reference.

TECHNICAL FIELD

The present invention relates to a method for manufacturing a cutting blade for cutting a workpiece such as an electronic material part used, for example, for a semiconductor product or the like, and a cutting blade.

BACKGROUND ART

High precision is required for grooving of a workpiece such as an electronic material part used for a semiconductor product or the like, or processing for dividing a workpiece into individual pieces by cutting (hereinafter abbreviated as cutting). For such cutting process, a disc-shaped cutting blade (thin blade grindstone) is used.

The cutting blade includes a blade main body having a disc shape and a cutting edge formed on an outer peripheral edge portion of the blade main body. The blade main body is formed by dispersing abrasive grains of diamond, cBN, or the like and fillers in a bonding phase (bonding agent) such as a resin phase (solid phase of a resin) or a metal phase (solid phase of a metal). For this reason, the blade main body includes the bonding phase, and the abrasive grains and the fillers dispersed in the bonding phase. A cutting blade in which the blade main body is formed of a resin phase (cutting blade in which the blade main body includes a resin phase as a bonding phase) is called a resin bonded blade (resin bonded grindstone).

In producing this type of cutting blade, the following methods have been conventionally used.

In the conventional manufacturing method shown in FIGS. 8(*a*) to 8(*c*), first, in FIG. 8(*a*), a mixed powder MP obtained by mixing a resin powder serving as a raw material of the resin phase, abrasive grains and fillers is filled in a die. Next, in FIG. 8(*b*), the surface of the mixed powder MP filled in the die is flattened by manual operation, machine, or the like. Then, in FIG. 8(*c*), the mixed powder MP is hot pressed and sintered. Further, although not specifically shown, after the hot press process, an outer periphery/inner periphery machining process, and in some cases, a lapping treatment (process of flattening blade surfaces (both side surfaces)) is performed to adjust the shape of the blade main body and form a cutting blade as a product.

Further, in the methods for manufacturing cutting blades of the following Patent Documents 1 and 2, a slurry containing a bonding agent is prepared, and the slurry is formed into a plate shape (sheet body) by a doctor blade method, and then die cutting, degreasing (removal of the binder added at the time of slurry preparation) and sintering are performed. It should be noted that when a resin bonded blade is manufactured, a binder is not used, and an alcohol or the like is used as a solvent for a resin serving as a bonding agent. By volatilizing this solvent, a plate-shaped molded article is obtained.

This type of cutting blade is required to perform cutting at higher speed rotation. That is, it is required to perform the cutting process by rotating the cutting blade at a higher speed. In order to perform the cutting process at high speed rotation, it is necessary to increase the strength of the cutting blade. As a technique for increasing the strength of the cutting blade, fibrous fillers are dispersed in the blade main body.

However, in the methods for manufacturing a cutting blade using the doctor blade method as in Patent Documents 1 and 2, in the case of using fibrous fillers, orientation of the fibrous fillers are aligned in the extending direction of the sheet body during the doctor blade process. More specifically, a recessed portion having a shape of a sheet body (cutting blade) is provided on the upper surface of a die, and the slurry is disposed on the upper surface of the die. Subsequently, the doctor blade is slid while in contact with the upper surface of the die, and the slurry is filled in the recessed portion and excess slurry is removed. At this time, the fibrous fillers are oriented in the extending direction of the sheet body (sliding direction of the doctor blade). For this reason, the fibrous fillers are oriented in a direction parallel to a specific radial direction of the cutting blade. As a result, the strength of the cutting blade varied in the circumferential direction of the blade.

In the method for manufacturing a cutting blade of Patent Document 3 described below, fibrous fillers are used as fillers. A solvent, abrasive grains and the fibrous fillers are mixed with the material of the resin phase to prepare a slurry. This slurry is dropwise added onto the rotation center of a rotating body such as a spin coater. The slurry dropwise added onto the rotating body expands due to centrifugal force to become a sheet body. At this time, the fibrous fillers in the slurry are oriented so as to extend radially from the rotation center. Then, the sheet body is molded into a circular plate shape, and the molded body is hot-pressed to form a blade main body.

According to this method, orientation of the fibrous fillers only in a certain direction is prevented, and the strength of the cutting blade is equalized over the entire blade circumferential direction.

However, the conventional method for manufacturing a cutting blade has the following problems.

In the conventional manufacturing method shown in FIGS. 8(*a*) to 8(*c*), in the step of FIG. 8(*b*), even when the surface of the mixed powder MP in the die is smoothed so that the surface of the mixed powder MP is apparently flattened, the packing density of the mixed powder MP varies. Therefore, in the case where fibrous fillers are used as fillers, the fibrous fillers do not uniformly disperse inside the blade main body, and the blade strength varies.

Further, as disclosed in Patent Documents 1 to 3, when manufacturing a cutting blade by molding a sheet body from a slurry, it was impossible to deal with a thermocompression-bondable resin. In other words, for example, with respect to a thermocompression-bondable resin such as a polyimide resin or the like, since there is no good solvent (that is, a solvent with high solubility for the resin), it was difficult to form a sheet body from the slurry, and the production itself was difficult.

It should be noted that in the doctor blade methods of Patent Documents 1 and 2, in the case where the content rate of the fibrous fillers in the entire blade main body is low (for example, in the case where it is 30 vol % or less), the sheet body can be formed in some cases. However, since the orientation of the fibrous fillers is aligned in a certain direction (extending direction of the sheet body) as described above, the strength of the cutting blade cannot be equalized in the blade circumferential direction.

PRIOR ART DOCUMENTS

Patent Documents

Patent Document 1: Japanese Unexamined Patent Application, First Publication No. H10-193267

Patent Document 2: Japanese Unexamined Patent Application, First Publication No. H10-193268

Patent Document 3: Japanese Unexamined Patent Application, First Publication No. 2015-98070

DISCLOSURE OF THE INVENTION

Problems to be Solved by the Invention

The present invention has been made in view of such circumstances, and the present invention aims to provide a method for manufacturing a cutting blade and a cutting blade, and the method that can easily manufacture a cutting blade including a resin phase of a thermocompression-bondable resin and in which fibrous fillers can be uniformly dispersed inside the blade main body without being oriented in a certain direction; and thereby, the strength is uniformly increased in the entire circumferential direction of the blade.

Solution for Solving the Problem

A method for manufacturing a cutting blade according to one aspect of the present invention includes: a mixing step of adding a liquid dispersion medium to a mixed powder containing a resin powder of a thermocompression-bondable resin, abrasive grains and fibrous fillers; a compression step of cold pressing, in a forming die, the mixed powder to which the dispersion medium has been added to form an original plate of a blade main body; and a sintering step of hot pressing and sintering the original plate.

In addition, a cutting blade according to one aspect of the present invention includes: a blade main body having a disc shape; and a cutting edge formed on an outer peripheral edge portion of the blade main body, wherein the blade main body includes: a resin phase formed of a thermocompression-bondable resin; and abrasive grains and fibrous fillers dispersed in the resin phase, and when the blade main body is divided into a plurality of regions at a mutually equal angle around the central axis of the blade main body, a content rate of the fibrous fillers measured in each region is from 90 to 110% with respect to an overall content rate of the fibrous fillers in the blade main body as a whole (entire blade main body).

In the method for manufacturing a cutting blade according to one aspect of the present invention, a liquid dispersion medium (dispersion medium in the form of a liquid) is added to a mixed powder containing a resin powder of a thermocompression-bondable resin, abrasive grains and fibrous fillers. Subsequently, the mixed powder containing the liquid dispersion medium is cold pressed in a forming die such as a metal mold or the like. Therefore, at the time of this cold pressing process, the dispersion medium enters the gaps between the powder particles of the mixed powder, and it is possible to promote the powder flow utilizing the liquid flow.

It should be noted that the "thermocompression-bondable resin" as referred to in one aspect of the present invention is included in thermosetting resins, and is a type of resin in which the resin powder serving as the raw material of the resin phase is formed so as to be in a state where the polymerization reaction is by and large (almost) completed, and which forms the resin phase by being integrated through thermocompression bonding during the sintering step. In other words, the "thermocompression-bondable resin" is a resin classified as a thermosetting resin. The resin powder as a raw material of the resin phase is composed of a thermosetting resin in a state in which the polymerization reaction is almost completed. During the sintering step, the resin powder is integrated by thermocompression bonding to form a resin phase. Examples of such thermocompression-bondable resins include polyimide resins, certain phenol resins, polybenzimidazole (PBI (registered trademark)), and the like.

Further, as the "dispersion medium", for example, chlorofluorocarbon (CFC) substitutes such as a fluorine-based inert liquid or the like can be used.

In addition, the "fibrous filler" refers to a filler having an elongated shape in which the average (value) of the aspect ratio (ratio represented by the formula: (length)/(outer diameter)) is 5 or more. As the fibrous filler, for example, various materials such as metals, carbon, glass, and the like can be used. It should be noted that examples of the fibrous filler also include those having an aspect ratio of 1,000 or more (so-called whiskers).

That is, in one aspect of the present invention, by applying pressure in a forming die to a mixture of a mixed powder and a dispersion medium in the compression step, the dispersion medium acts like a lubricant, so that the resin powder, the abrasive grains and the fibrous fillers uniformly diffuse in the forming die. For this reason, variation in the density of the original plate of the blade main body to be produced is remarkably suppressed to a low level, and the fibrous fillers are uniformly dispersed in the original plate.

At this time, although the fibrous fillers face toward a direction intersecting with the thickness direction of the blade main body (that is, any one direction of all directions (360 degrees) in a plane substantially perpendicular to the central axis of the blade main body), the fibrous fillers are not oriented in a certain direction, and the fibrous fillers are brought into a non-oriented dispersed state having no regularity in orientation (that is, randomly oriented). In other words, since a plurality of fibrous fillers are randomly oriented, they are substantially oriented and dispersed in all directions (360 degrees).

It should be noted that during this compression step, since the cold pressing (cold compression) is performed, thermocompression bonding of the resin powder does not proceed and the fluidity of the resin powder is secured in a stable manner.

Then, the original plate of this blade main body is hot pressed and sintered. As described above, since variation in the density of the original plate is suppressed to a low level, the occurrence of sink marks or the like in the blade main body at the time of sintering can be suppressed. As a result, it is possible to manufacture a blade main body in which warpage and flatness are suppressed to low levels.

It should be noted that sink marks are indentations or depressions generated by the shrinkage caused by materials. In the case where the variation in the density of the original plate is large, at the time of sintering, a portion with low density shrinks more than other portions, and there is a possibility that indentations or depressions may occur. The indentations and depressions caused by this shrinkage are called sink marks.

Further, since the fibrous fillers are uniformly dispersed from the time of molding the original plate, even in the blade main body obtained by sintering the original plate, the fibrous fillers are uniformly dispersed in the circumferential direction and the radial direction of the blade. Therefore, it is possible to obtain an excellent cutting blade having no variation in strength. More specifically, as described above, since the fibrous fillers are not oriented in a certain direction and randomly oriented in an unspecified direction (all directions (360 degrees)) in a plane substantially perpendicular to the central axis of the blade main body, the fibrous fillers function like aggregates and the strength is equally increased in the entire blade circumferential direction.

In addition, since the fibrous fillers are uniformly dispersed in random orientation in the blade main body, the following actions and effects can also be obtained.

Improvement of wear resistance.

Suppression of blade thinning.

Moderate self-sharpening action.

Improvement of toughness.

Improvement of heat resistance.

That is, since the fibrous fillers are uniformly dispersed in the blade main body in random orientation, the blade main body does not easily wear at predetermined portions in the circumferential direction, and the wear progresses uniformly over the entire circumferential direction. As a result, the abrasion amount of the blade as a whole is also suppressed, and the wear resistance is improved. In addition, since the wear resistance is improved, the tool life is prolonged (tool life is improved).

Further, the fibrous fillers are randomly oriented in a plane substantially perpendicular to the central axis of the blade main body. Therefore, with respect to both side surfaces (front and back surfaces of the blade) facing the thickness direction of the blade main body, for example, the circumferential surface and the longitudinal cross section (cross section along the extending direction of the filler) of the fibrous filler having an elongated columnar shape are exposed, so that exposure of end surfaces facing the extending direction of the fibrous filler and the transverse cross section (cross section perpendicular to the extending direction of the filler) can be suppressed. On the other hand, with respect to the outer circumferential surface facing outward in the radial direction of the blade main body, it varies in that some of the fibrous fillers expose their circumferential surfaces and longitudinal cross sections, while some fibrous fillers expose their end surfaces and transverse cross sections.

Therefore, the ratio of the exposed area of the fibrous fillers per unit area of the outer surface of the blade with respect to the both side surfaces of the blade main body becomes large. In comparison with this, the ratio of the exposed area of the fibrous fillers per unit area of the outer surface of the blade with respect to the outer circumferential surface of the blade main body becomes small. That is, with respect to the exposed area of the fibrous fillers per unit area of the outer surface of the blade, the exposed area of the fibrous fillers on both side surfaces becomes larger than the exposed area of the fibrous fillers on the outer circumferential surface of the blade main body. For this reason, on the outer peripheral surface of the blade main body, it is possible to appropriately allow wear to proceed and to maintain the sharpness of the cutting edge satisfactorily (it is possible to promote the self-sharpening action). Further, on both side surfaces of the blade main body, it is possible to suppress the progress of wear and to suppress the blade thinning. Therefore, in the cut surface formed on the workpiece by the cutting process, defects such as inclinations due to the blade thinning hardly occur, and the quality of the cutting process is markedly enhanced.

Further, in one aspect of the present invention, the blade strength is improved by uniform dispersion and random orientation of the fibrous fillers. For this reason, for example, compared with a case where the blade strength is to be enhanced by simply using particulate fillers having high hardness without using fibrous fillers which is unlike one aspect of the present invention, it is possible to promote a moderate self-sharpening action in one aspect of the present invention.

That is, when attempting to enhance the blade strength by using the conventional particulate fillers, a characteristic orientation cannot be imparted to the particulate fillers; and therefore, a method of simply increasing the hardness of the particulate fillers is adopted. However, as the hardness of the particulate fillers increases, the holding power of the abrasive grains becomes too high at the cutting edge; and thereby, it becomes difficult to form a new blade (the self-sharpening action is reduced). For this reason, the sharpness cannot be maintained satisfactorily.

On the other hand, if fibrous fillers are used as is the case with one aspect of the present invention, the blade strength can be increased without increasing the hardness of the fillers; and therefore, it is possible to promote a moderate self-sharpening action and to maintain the sharpness satisfactorily.

In addition, since the fibrous fillers are uniformly dispersed and randomly oriented inside the blade main body, these fibrous fillers act like aggregates, and the toughness of the blade main body is improved. For this reason, the strength of the cutting blade is increased while the impact resistance is also improved, and in particular, rigidity is sufficiently secured even in the cutting process during high speed rotation, and high-quality cutting precision can be maintained.

Further, since the fibrous fillers are uniformly dispersed and randomly oriented, it is possible to improve the thermal conductivity between the fibrous fillers inside the blade main body. For this reason, for example, in the case of using metal fibers, carbon fibers or the like having a high thermal conductivity as the fibrous fibers, the frictional heat generated at the outer peripheral edge portion (cutting edge) of the blade main body during the cutting process is thermally dissipated in the blade at an early stage through the fibrous fillers, and the cooling efficiency is also improved; and thereby, the heat resistance of the cutting blade is improved.

It should be noted that most of the dispersion medium added to the mixed powder before cold pressing flows out from the mixed powder (original plate of the blade main body) at the time of cold pressing and is removed. Further, the dispersion medium remaining on the original plate of the blade main body after cold pressing can be removed from the blade main body, for example, by volatilization before hot pressing in the sintering step. At this time, since the dispersion medium is present in a slight space between the powder particles, formation of the blade main body in a porous form by volatilization of the dispersion medium is prevented. Further, in this case, since the dispersion medium does not remain in the blade main body produced through the sintering step, the performance of the blade main body is not adversely affected by the dispersion medium.

More specifically, it is preferable that the timing at which the dispersion medium is volatilized in the sintering step is before the start of the thermocompression bonding of the resin powder by hot pressing. In other words, it is preferable that all of the dispersion medium is volatilized before conducting the hot pressing process (before the sintering step). As a result, the space in which the dispersion medium has been present between the powder particles is occupied (replaced) by the resin phase, so that traces of the dispersion medium are not left in the blade main body after sintering. Therefore, the dispersion medium and its traces do not adversely affect the performance of the blade main body.

More specifically, in the cutting blade manufactured according to one aspect of the present invention, the blade main body is divided into a plurality of regions at a mutually equal angle around the central axis of the blade main body (for example, four regions obtained by dividing the blade main body into four equal parts around the central axis), and the content rate of the fibrous fillers obtained in each region is suppressed to 90 to 110% with respect to the overall content rate of the fibrous fillers in the entire blade main body. That is, the ratio (percentage) of the content rate of the fibrous fillers in each region with respect to the overall content rate of the fibrous fillers in the entire blade main body is from 90 to 110%.

In other words, the fibrous fillers are uniformly contained in each region of the blade main body, and the fibrous fillers are uniformly dispersed over the entire region of the blade main body. This is because, as described above, the fibrous fillers have already been uniformly dispersed over the entire blade in the original plate of the blade main body that has undergone the compression step by cold pressing. Therefore, the manufactured blade main body has excellent rigidity with no variation in strength over the entire blade.

It should be noted that the content rate of the fibrous fillers in each region of the blade main body can be obtained, for example, by the following method.

First, the entire side surface of the blade main body is polished in the thickness direction to expose the fibrous fillers disposed inside the side surface in the thickness direction. Next, the polished side surface of the blade main body is photographed by a scanning electron microscope (SEM) or the like. By binarizing the photographed image, an image data that can distinguish between the fibrous filler and other members is created. In this image data, the blade main body is divided into a plurality of regions at a mutually equal angle around the central axis of the blade main body (for example, four regions obtained by dividing the blade main body into four equal parts around the central axis). The ratio of the area occupied by the fibrous fillers with respect to the area of each region (the entire area of the region) is determined. This ratio is defined as the content rate of the fibrous fillers in each region of the blade main body.

However, the method of determining the content rate of the fibrous fillers in each region of the blade main body is not limited to the above method.

In addition, the overall content rate of the fibrous fillers in the entire blade main body may be obtained from the above image data or may be obtained from the ratio of the volume of the fibrous fillers with respect to the volume of the entire blade main body.

Further, in the cutting blade manufactured according to one aspect of the present invention, the blade main body is divided into a plurality of regions at a mutually equal angle around the central axis of the blade main body (for example, eight regions obtained by dividing the blade main body into eight equal parts around the central axis), and an average value of the densities measured in the regions is taken as the average density. The density measured in each region can be suppressed to, for example, 90 to 110% with respect to this average density. That is, the ratio (percentage) of the density of each region with respect to the average density value is, for example, from 90 to 110%. In other words, the density difference (variation in density) is suppressed to a low level over the entire region of the blade main body. This is because, as described above, the density difference has already been suppressed to a low level in the original plate of the blade main body that has undergone the compression step by cold pressing. Therefore, the warpage and flatness of the produced blade main body are suppressed to low levels.

More specifically, in the cutting blade manufactured according to one aspect of the present invention, for example, the warpage amount of the blade main body can be suppressed to 300 μm or less. Further, the flatness of the blade main body can be suppressed to 20 μm or less.

In addition, the flatness of both side surfaces facing the thickness direction of the blade main body obtained after sintering is suppressed to a low level as described above. Therefore, even in a field of application where high-quality cutting precision is particularly required, it is possible to satisfy the expected (desired) flatness without flattening both side surfaces of the blade main body by a lapping treatment.

It should be noted that the warpage amount of the blade main body is measured by the following method. As shown in FIGS. 5(*a*) and 5(*b*), a cutting blade 10 is placed on a surface plate S. While rotating the surface plate S, a laser beam L of a laser interferometer is irradiated to the cutting blade 10 to measure the height (the height from the surface plate S) of the entire circumference of the cutting blade 10. The blade thickness is subtracted from the maximum value (height at the position farthest from the surface plate S) of the measured values, and the obtained value is taken as the warpage amount of the blade main body. It should be noted that this measurement is performed on both surfaces (both side surfaces facing the thickness direction) of the blade main body, and the larger numerical value is adopted.

Further, the flatness of the blade main body is measured by the following method. The blade main body is divided into a plurality of regions at a mutually equal angle around the central axis of the blade main body (for example, eight regions obtained by dividing the blade main body into eight equal parts around the central axis). In each region, the thickness of the blade main body is measured with a micrometer or the like. The maximum difference in the variation of measured values (the difference between the maximum thickness and the minimum thickness) is the flatness of the blade main body.

As described above, since the warpage and the flatness of the blade main body are suppressed to low levels, the following actions and effects can be obtained when a workpiece is cut with this cutting blade.

That is, since the deflection of the cutting blade in the thickness direction is suppressed, the cutting width is suppressed to a small value, and the product yield of the workpiece can be improved. In addition, a force from the cutting blade to the workpiece in the cutting width direction (the width direction of the cutting line formed on the workpiece by the cutting process) hardly acts. For this reason, the cutting blade smoothly cuts into the workpiece, and the occurrence of burrs, chipping or the like on the cut surface is prevented. Therefore, the quality of the electronic material parts (products) and the like obtained by dividing the workpiece into individual pieces can be stably increased.

Furthermore, since it is unnecessary to perform a lapping treatment on the blade surface, there is no possibility that the abrasive grains protrude from the resin phase by this lapping treatment. That is, in one aspect of the present invention, the blade main body obtained through the sintering step includes the abrasive grains disposed further to the inside than the side surface of the blade main body in the thickness direction, and there are no abrasive grains protruding outward in the thickness direction from the side surface. For this reason, it is possible to remarkably suppress problems such as the abrasive grains protruding from the side surface of the blade main body to roughen the cut surface of the workpiece and lower the processing quality (generate burrs, chipping or the like) during the cutting process. Therefore, the cutting precision can be particularly enhanced by this effect that no abrasive grains protrude from the side surface in conjunction with the effect that the flatness can be suppressed to a low level as described above.

More specifically, conventionally, particularly in the case of attempting to reduce the thickness of the blade main body to 1.1 mm or less, it has been essential to carry out a lapping treatment in order to suppress the flatness of the blade surface to a small value and to reduce the thickness of the blade main body down to the expected thickness (thin it down to the desired thickness). For this reason, it was impossible to prevent the abrasive grains from protruding from the side surface of the blade main body.

On the other hand, according to one aspect of the present invention, even if the thickness of the blade main body is reduced to, for example, 1.1 mm or less, the flatness has already been suppressed to a small value after sintering; and therefore, the lapping treatment is unnecessary. As a result, it is possible to reliably prevent the abrasive grains from protruding from the side surface of the blade main body. That is, both side surfaces of the blade main body that have undergone the sintering step are in a state where the surface is formed flat by the pressing process and there is no protrusion of abrasive grains. For this reason, by omitting the lapping treatment, it is possible to reduce the number of abrasive grains protruding from the blade surface to zero.

Furthermore, since it is unnecessary to perform a lapping treatment, not only the production is facilitated, but also it becomes unnecessary to form the blade main body with a large thickness in advance in anticipation of the lapping treatment as in the prior art, and the material cost is reduced.

Further, in the prior art, the reaction force received by the cutting blade when cutting the workpiece acted unevenly against the portion having a large amount of warpage. In one aspect of the present invention, the warpage and flatness of the blade main body are suppressed to low levels; and thereby, the above problems are prevented. In other words, according to one aspect of the present invention, since the above reaction force is more likely to act uniformly over the entire circumference in the circumferential direction of the cutting blade, and the application of a large load to a predetermined portion is prevented, the tool life of the cutting blade is prolonged (the tool life is improved).

Further, in manufacturing a cutting blade in which the cutting precision is markedly enhanced as described above, in comparison with the conventional manufacturing method, a particularly complicated manufacturing process is not used in one aspect of the present invention. More specifically, in one aspect of the present invention, by passing through a simple process of cold pressing a mixed powder to which a dispersion medium has been added in a forming die, variation in the density of the blade main body (original plate) is suppressed, while the fibrous fillers are uniformly dispersed and the fibrous fillers are randomly oriented. As a result, since the above-mentioned excellent actions and effects can be achieved, it is easy to manufacture the cutting blade.

As described above, according to the method for manufacturing a cutting blade of one aspect of the present invention, it is possible to include a resin phase composed of a thermocompression-bondable resin, and the fibrous fillers can be uniformly dispersed without orienting the fibrous fillers in a certain direction inside the blade main body. As a result, it is possible to easily manufacture a cutting blade in which the strength is uniformly increased in the entire blade circumferential direction.

Further, according to the cutting blade of one aspect of the present invention, since the strength is uniformly increased in the entire circumferential direction of the blade, the cutting process can be stably performed at high speed rotation.

In addition, in the above method for manufacturing a cutting blade, it is preferable that the mixing step includes: a step of filling the forming die with the mixed powder containing the resin powder of the thermocompression-bondable resin, the abrasive grains and the fibrous filler; a step of flattening a surface of the mixed powder; and a step of dropwise adding the liquid dispersion medium onto the mixed powder.

In this case, since the mixing step includes the step of flattening the surface of the mixed powder filled in the forming die, the flow amount of the mixed powder until it diffuses uniformly into the forming die in the compression step which is a subsequent step of this mixing step can be suppressed to a low level. For this reason, the following actions and effects are achieved (obtained) more stably.

The above-described effect that variation in the density of the original plate of the blade main body can be suppressed to a low level.

The effect that the fibrous fillers are uniformly dispersed in the interior of the original plate while the fibrous fillers are randomly oriented without being oriented in a certain direction.

In addition, since the mixing step includes the step of dropwise adding the dispersion medium to the mixed powder whose surface has been flattened, the dispersion medium is more easily mixed uniformly with the mixed powder. In other words, since the dispersion medium easily spreads all over the mixed powder as a whole and increases the affinity therewith, the powder flow of the mixed powder making use of (utilizing) the liquid flow of the dispersion medium is uniformly distributed over the entire interior of the forming die in the compression step which is a subsequent step of this mixing step. Therefore, the following actions and effects are achieved (obtained) more stably.

The above-described effect that variation in the density of the original plate of the blade main body can be suppressed to a low level.

The effect that the fibrous fillers are uniformly dispersed in the interior of the original plate while the fibrous fillers are randomly oriented without being oriented in a certain direction.

In addition, in the above method for manufacturing a cutting blade, it is preferable that a liquid having a kinematic viscosity of 2.3 $mm^2/s$ or less is used as the dispersion medium.

In this case, since the kinematic viscosity of the dispersion medium is 2.3 $mm^2/s$ or less (2.3 cSt or less), the dispersion medium spreads between the powder particles of the mixed powder, and increases the affinity with the powder particles of the mixed powder to facilitate the liquid flow over a wide range, and the dispersion medium also effectively functions as a lubricant to promote the powder flow of the mixed powder. As a result, in the compression step, the effect of uniformly diffusing the mixed powder into the forming die can be obtained more remarkably.

More specifically, in the case where the kinematic viscosity of the dispersion medium is equal to or less than 2.3 $mm^2/s$, the warpage and flatness of the blade main body obtained after sintering are remarkably suppressed to low levels, and the strength of the entire blade is remarkably increased.

It should be noted that the above-described "kinematic viscosity" is a kinematic viscosity required at the time of cold pressing in the compression step, and refers to, for example, the kinematic viscosity of a liquid at 25° C.

In addition, in the above cutting blade, when the blade main body is divided into a plurality of regions at a mutually equal angle around the central axis of the blade main body, and an average value of densities measured in the regions is taken as an average density, it is preferable that the density measured in each region is from 90 to 110% with respect to the average density.

Further, in the above cutting blade, it is preferable that the overall content rate of the fibrous fillers in the blade main body as a whole (entire blade main body) is from 20 to 60 vol %.

In this case, since the overall content rate of the fibrous fillers in the entire blade main body is from 20 to 60 vol %, it is possible to reliably achieve the actions and effects brought about by the fibrous fillers as described above, while preventing reduction in the blade rigidity due to inclusion of an excessive amount of the fibrous fillers.

That is, since the overall content rate of the fibrous fillers is equal to or more than 20 vol %, the above-described actions and effects due to the dispersion of the fibrous fillers in the blade main body can be reliably obtained. In addition, since the overall content rate of the fibrous fillers is equal to or less than 60 vol %, it is possible to suppress the excessive reduction of the resin phase serving as a bonding agent interposed between the fibrous fillers; and thereby, the function of the resin phase is stabilized.

Further, in the above cutting blade, it is preferable that a warpage amount of the blade main body is equal to or less than 300 μm.

In addition, in the above cutting blade, it is preferable that a flatness of the blade main body is equal to or less than 20 μm.

Since the variation in the density of the blade main body is suppressed to a low level, the warpage amount of the blade main body can be suppressed to as low as 300 μm or less. In addition, the flatness of the blade main body can be suppressed to as low as 20 μm or less. For this reason, at the time of manufacturing the cutting blade, it is possible to reduce (omit) operations such as a lapping treatment for flattening the blade surfaces (both side surfaces).

Therefore, while improving the ease of manufacturing the cutting blade, the cutting precision by the cutting blade can be remarkably enhanced.

More specifically, in a conventional cutting blade, as described with reference to FIGS. 8(*a*) to 8(*c*), since variation tends to occur in the packing density inside the mixed powder in the forming die at the time of manufacturing the blade, the flatness of the side surface of the blade main body obtained after sintering was, more or less, as large as 100 μm (about 100 μm). For this reason, in the field of application where the cutting precision was particularly required, both side surfaces of the blade main body were subjected to a lapping treatment for planarization. However, even if the resin phase is removed by the lapping treatment, abrasive grains with high hardness tend to remain in a state of being protruded from the side surface, and it was difficult to satisfy the expected (desired) flatness.

On the other hand, according to the cutting blade of one aspect of the present invention, since the variations in the packing density inside the mixed powder in the forming die can be suppressed to a small value, the flatness of the side surface of the blade main body obtained after sintering can be suppressed to as low as 20 μm or less. Therefore, even in a field of application where the cutting precision is particularly required, it is possible to satisfy the expected (desired) flatness without flattening both side surfaces of the blade main body by a lapping treatment.

Furthermore, since it is unnecessary to subject the blade surface to a lapping treatment, there is no possibility that the abrasive grains protrude from the resin phase by this lapping treatment. In other words, there are no abrasive grains protruding in the thickness direction on the side surface of the blade main body obtained through the sintering step; and therefore, the cutting precision can be particularly enhanced by this effect that no abrasive grains protrude from the side surface in conjunction with the effect that the flatness can be suppressed to a low level as described above.

In addition, in the above cutting blade, it is preferable that the thickness of the blade main body is equal to or less than 1.1 mm.

Since the strength of the cutting blade is increased in the entire region of the blade main body as described above, it is easy to reduce the thickness of the blade main body to 1.1 mm or less while ensuring the rigidity of the blade main body.

Therefore, it is possible to more remarkably obtain the effect that the cutting width of the workpiece can be suppressed to a small value to improve the product yield while satisfactorily maintaining the cutting precision.

Effects of the Invention

According to the method for manufacturing a cutting blade of one aspect of the present invention, it is possible to include a resin phase composed of a thermocompression-bondable resin, and the fibrous fillers can be uniformly dispersed without orienting the fibrous fillers in a certain direction inside the blade main body. As a result, it is possible to easily manufacture a cutting blade in which the strength is uniformly increased in the entire blade circumferential direction.

Further, according to the cutting blade of one aspect of the present invention, since the strength is uniformly increased in the entire circumferential direction of the blade, the cutting process can be stably performed at high speed rotation.

EMBODIMENTS FOR CARRYING OUT THE INVENTION

Hereinafter, a cutting blade 10 according to an embodiment of the present invention and a manufacturing method thereof will be described with reference to the drawings.

Examples of the electronic material parts to be cut and manufactured by the cutting blade 10 of the present embodiment include those that are cut and divided from a semiconductor wafer, like a semiconductor element, and then mounted on a lead frame and subjected to resin molding, and, for example, also those described below.

(a) Electronic material parts, such as those referred to as QFN (quad flat non-leaded packages), that are manufactured by collectively mounting a large number of devices on a lead frame, and collectively molding and then cutting these into individual pieces.

(b) Electronic material parts having a substrate in which Ni, Au, Cu or the like is plated on the inner circumferential surface of a through hole formed in a base made of a glass epoxy resin, and divided into individual pieces by cutting, like an optical transmission module based on the IrDA (Infrared Data Association) standard (hereinafter simply abbreviated as IrDA).

The cutting blade 10 of the present embodiment is used to precisely cut a workpiece, such as these types of electronic material parts.

Figure 1:
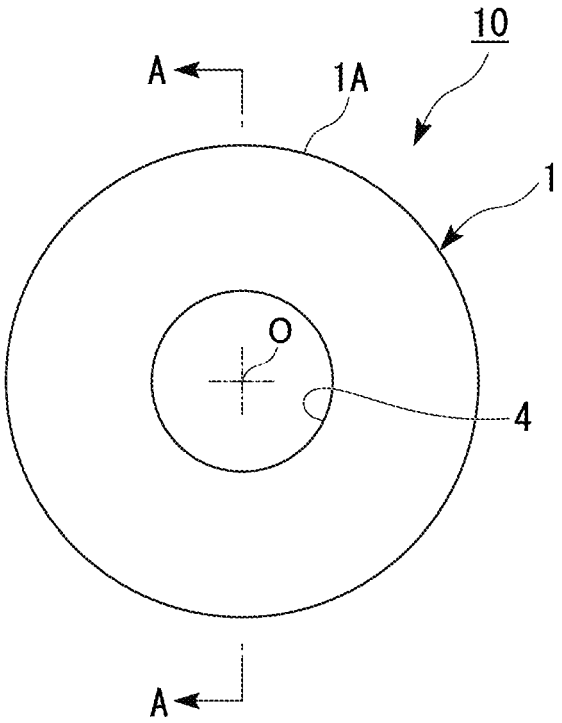
FIG. 1 is a side view (plan view) showing a cutting blade according to one embodiment of the present invention.
Figure 2:
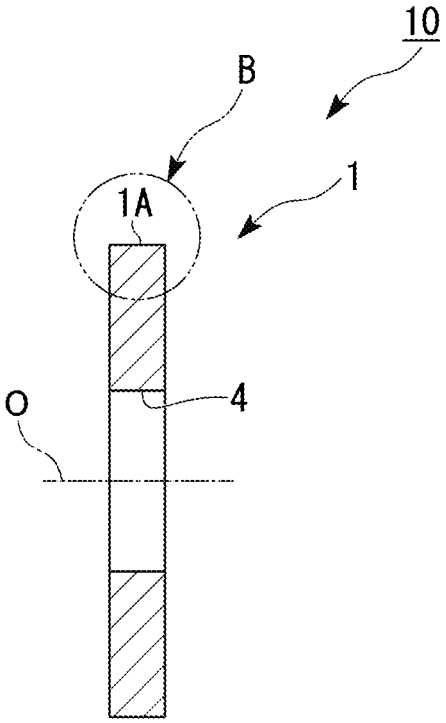
FIG. 2 is a cross sectional view taken along the line A-A in FIG. 1.

As shown in FIGS. 1 and 2, the cutting blade 10 includes a blade main body 1 having a disc shape and a cutting edge 1A formed at an outer peripheral edge portion of the blade main body 1.

Although not specifically shown, the blade main body 1 of the cutting blade 10 is attached to the main shaft of a cutting apparatus via a flange. The cutting blade 10 is fed in a direction perpendicular to the central axis O while being rotated around the central axis O of the blade main body 1; and thereby, the workpiece is cut at the outer peripheral edge portion (cutting edge 1A) projecting outward in the radial direction from the flange in the blade main body 1.

In the present embodiment, a direction along the central axis O of the blade main body 1 (the direction in which the central axis O extends) is referred to as a thickness direction of the blade main body 1 or simply as a direction of the central axis O. Further, this thickness direction may be referred to as the cutting width direction of the cutting blade 10 (corresponding to the width direction of the cutting line formed on the workpiece by the cutting process).

Moreover, a direction orthogonal to (perpendicular to) the central axis O is referred to as a radial direction, and a direction orbiting around the central axis O is referred to as a circumferential direction.

The size (that is, the thickness) along the thickness direction of the blade main body 1 is, for example, 0.1 mm or more and 1.1 mm or less. Therefore, the blade main body 1 has an extremely thin disc shape. It should be noted that in FIG. 2, in order to make the shape of the cutting blade 10 easier to understand, the thickness of the blade main body 1 is shown thicker than the actual thickness.

In addition, a mounting hole 4 having a circular hole shape centered on the central axis O and penetrating the blade main body 1 in the thickness direction is formed in a central portion (on the central axis O) in the radial direction of the blade main body 1. Therefore, more specifically, the blade main body 1 has an annular plate shape. The "blade main body 1 having a disc shape" as referred to in the present embodiment includes the blade main body 1 having an annular plate shape.

Figure 3:
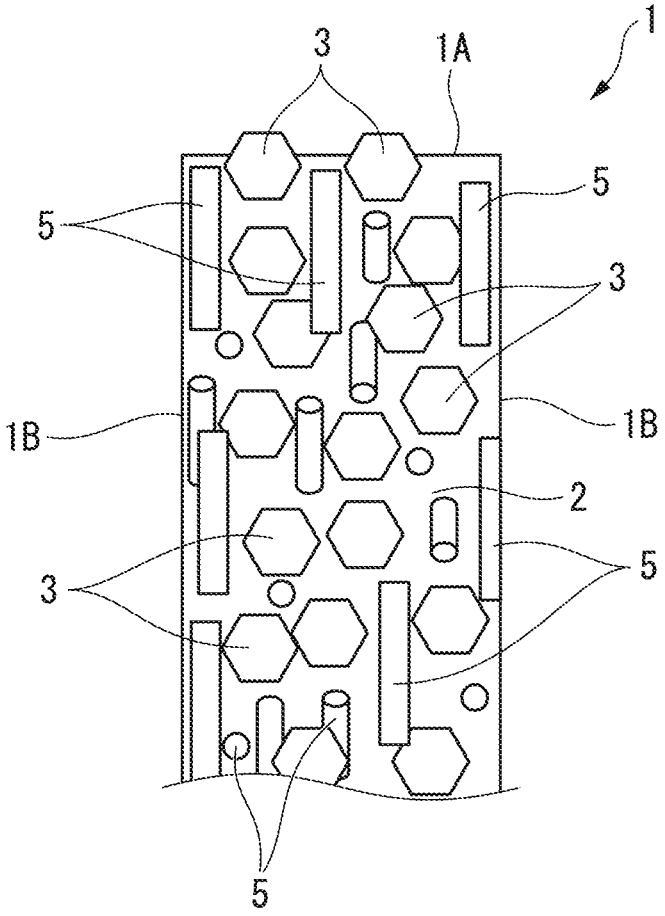
FIG. 3 is an enlarged view of a portion B of FIG. 2.

As shown in FIG. 3, the cutting edge 1A of the blade main body 1 is formed to include: an outer circumferential surface of the blade main body 1 which has an extremely small width equal to the thickness of the blade main body 1; each of outer peripheral edge portions in both side surfaces 1B, 1B facing the thickness direction of the blade main body 1; and a pair of edge portions forming an intersecting ridgeline between the outer peripheral edge portions and the outer circumferential surface.

The blade main body 1 includes: a resin phase 2 formed of a thermocompression-bondable resin; abrasive grains 3 dispersed in the resin phase 2 and composed of a material harder than the resin phase 2; and fibrous fillers 5 dispersed in the resin phase 2 and composed of a material softer than the abrasive grains 3. That is, the blade main body 1 includes the resin phase 2, the abrasive grains 3 dispersed in the resin phase 2, and the fibrous fillers 5 dispersed in the resin phase 2.

It should be noted that the content rates of the resin phase 2, the abrasive grains 3 and the fibrous fillers 5 in the blade main body 1 are the same as the mixing rates of the resin powder, the abrasive grains 3 and the fibrous fillers 5 in a mixed powder MP used in the production process described later.

The resin phase 2 is a resin bonding agent phase (resin bond matrix material) containing as a main component, for example, a synthetic resin such as a polyimide resin, a portion of phenol resins (certain phenol resins) and polybenzimidazole (PBI (registered trademark)).

It should be noted that the "thermocompression-bondable resin" as referred to in the present embodiment is included in thermosetting resins, and is a type of resin in which the resin powder serving as the raw material of the resin phase 2 is formed so as to be in a state where the polymerization reaction is by and large (almost) completed, and which forms the resin phase 2 by being integrated through thermocompression bonding during the sintering step.

The abrasive grains 3 contain either diamond abrasive grains or cBN abrasive grains. In the present embodiment, diamond abrasive grains are used as the abrasive grains 3.

The fibrous filler 5 refers to a filler having an elongated shape in which the average (value) of the aspect ratio (ratio represented by the formula: (length)/(outer diameter)) is 5 or more. As the fibrous filler 5, for example, various materials such as metals, carbon, glass, and the like can be used. It should be noted that examples of the fibrous filler 5 also include those having an aspect ratio of 1,000 or more (so-called whiskers). The aspect ratio of the fibrous fillers 5 is preferably 5 or more and 100 or less.

In the present embodiment, although a single type of material is used as the fibrous filler 5 to be dispersed in the blade main body 1, the material is not limited thereto, and a plurality of types of fibrous fillers 5 may be dispersed in the blade main body 1. That is, a plurality of types of fibrous fillers 5 having different lengths, aspect ratios, materials and the like with each other may be used. Furthermore, as a filler, a particulate filler may be used together with the fibrous filler 5.

Both the abrasive grains 3 and the fibrous fillers 5 are composed of a material harder than the resin phase 2. The abrasive grains 3 mainly contribute to the improvement of cutting processability, and the fibrous fillers 5 mainly contributes to the improvement of rigidity of the blade main body 1. It should be noted that the materials of the abrasive grains 3 and the fibrous fillers 5 are not limited to those described in the present embodiment.

As shown in FIG. 3, the abrasive grains 3 do not protrude from both side surfaces 1B, 1B facing the thickness direction of the blade main body 1. Further, the fibrous fillers 5 also do not protrude from both side surfaces 1B, 1B facing the thickness direction of the blade main body 1. In other words, the abrasive grains 3 and the fibrous fillers 5 are entirely disposed further to the inside than the side surface 1B of the blade main body 1 in the thickness direction.

It should be noted that regarding the outer edge (outer peripheral edge) of the blade main body 1 in the radial direction, due to a dressing treatment or the like of the cutting edge 1A, either one of the abrasive grains 3 and the fibrous fillers 5 may be protruded from the resin phase 2 within a range so that they do not protrude at a portion of the side surface 1B other than the outer peripheral edge to the outside in the thickness direction.

In the example shown in FIG. 3, either one of the abrasive grains 3 and the fibrous fillers 5 protrude from the outer circumferential surface facing outward in the radial direction of the blade main body 1.

In the cutting blade 10 of the present embodiment, the blade main body 1 is divided into a plurality of regions at a mutually equal angle around the central axis O of the blade main body 1. The content rate of the fibrous fillers 5 measured in each region is set to 90 to 110% with respect to the overall content rate of the fibrous fillers 5 in the entire blade main body 1.

It should be noted that the content rate of the fibrous fillers 5 in each region of the blade main body 1 can be obtained, for example, by the following method.

First, the entire side surface 1B of the blade main body 1 is polished in the thickness direction to expose the fibrous fillers 5 disposed inside the side surface 1B in the thickness direction. Next, the polished side surface 1B of the blade main body 1 is photographed by a scanning electron microscope (SEM) or the like. By binarizing the photographed image, an image data that can distinguish between the fibrous filler 5 and other members is created. In this image data, the blade main body 1 is divided into a plurality of regions at a mutually equal angle around the central axis O of the blade main body 1 (for example, four regions obtained by dividing the blade main body 1 into four equal parts around the central axis O). The ratio of the area occupied by the fibrous fillers 5 with respect to the area of each region (the entire area of the region) is determined. This ratio is defined as the content rate of the fibrous fillers 5 in each region of the blade main body 1.

However, the method of determining the content rate of the fibrous fillers 5 in each region of the blade main body 1 is not limited to the above method.

In addition, the overall content rate of the fibrous fillers 5 in the entire blade main body 1 may be obtained from the above image data or may be obtained from the ratio of the volume of the fibrous fillers 5 with respect to the volume of the entire blade main body 1.

Figure 4:
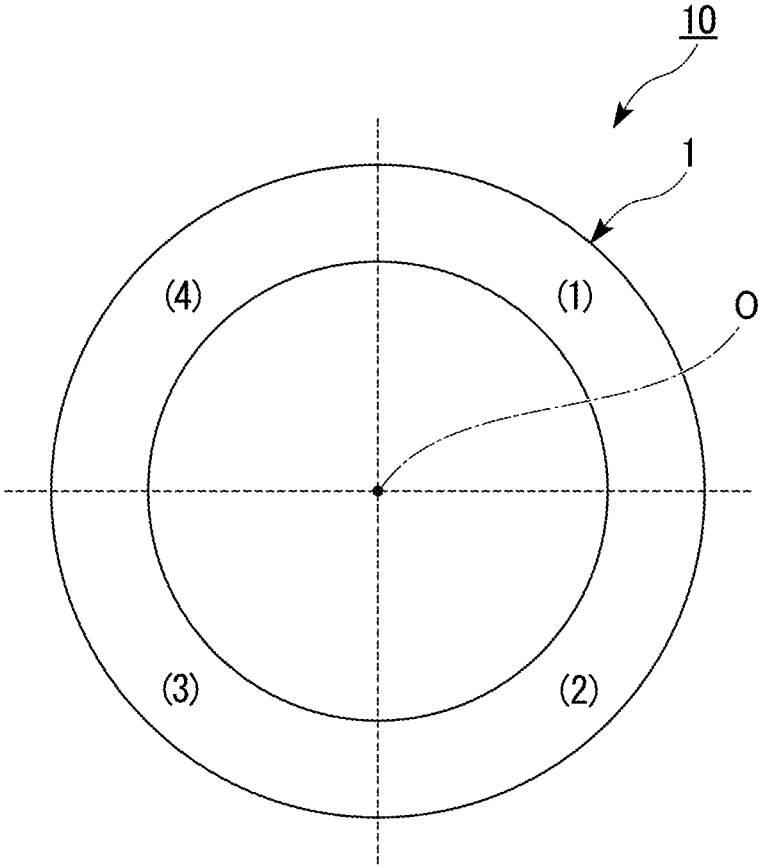
FIG. 4 is a view for explaining a variation in a content rate of fibrous fillers in each region of a blade main body.

More specifically, in the present embodiment, as shown in FIG. 4, the blade main body 1 is divided into four equal parts around the central axis O of the blade main body 1 to be divided into four regions. With respect to the overall content rate of the fibrous fillers 5 in the entire blade main body 1, all of the content rates of the fibrous fillers 5 in the four regions fall within the range of 90 to 110% (within ±10% when the overall content rate is taken as 100%). That is, the ratio (percentage) of the content rate of the fibrous fillers 5 in each region with respect to the overall content rate of the fibrous fillers 5 in the entire blade main body 1 is in the range of 90 to 110%.

More specifically, in the cutting blade 10 of the present embodiment, the content rate of the fibrous fillers 5 in each region is within the range of 95 to 105% with respect to the overall content rate of the fibrous fillers 5 (within ±5% when the overall content rate is taken as 100%).

It should be noted that in the present specification, the expression "when X is taken as 100%, Y is within the range of ±Z %" means that the ratio of Y with respect to X (Y/X) (percentage) is within the range of (100−Z)% to (100+Z)%.

It should be noted that in the present embodiment, although the blade main body 1 is divided into four equal parts around the central axis O of the blade main body 1 to be divided into four regions, and the content rate of the fibrous fillers 5 is determined in each region, the method is not limited thereto. That is, the blade main body 1 may be divided into a plurality of regions at a mutually equal angle around the central axis O of the blade main body 1, and the content rate of the fibrous fillers 5 may be determined in each region. Therefore, the number of equally divided regions is not limited to four. However, in order to secure the accuracy of the content rate of the fibrous fillers 5, it is preferable that the number of equally divided regions is at least 4 or more.

Further, in the present embodiment, the overall content rate of the fibrous fillers 5 in the entire blade main body 1 is from 20 to 60 vol %. That is, the ratio of the volume of the fibrous fillers 5 with respect to the volume of the entire blade main body 1 is from 20 to 60%. It should be noted that the overall content rate of the fibrous fillers 5 in the entire blade main body 1 is more preferably 30 vol % or more and 50 vol % or less.

In addition, in the cutting blade 10 of the present embodiment, the blade main body 1 is divided into a plurality of regions at a mutually equal angle around the central axis O of the blade main body 1, and an average value of the densities measured in the regions is taken as the average density. The density measured in each region is from 90 to 110% with respect to this average density. That is, the ratio (percentage) of the density of each region with respect to the average density value is within the range of 90 to 110%.

That is, although not specifically shown, the blade main body 1 is divided into eight equal parts around the central axis O of the blade main body 1 to be divided into eight regions. Then, the average value of the densities measured in the eight regions is defined as the average density. All the densities measured in the eight regions are within the range of 90 to 110% with respect to this average density (within ±10% when the average density is taken as 100%).

More specifically, in the cutting blade 10 of the present embodiment, the density measured in each region is within the range of 95 to 105% with respect to the average density (within ±5% when the average density is taken as 100%).

It should be noted that in the present embodiment, although the blade main body 1 is divided into eight equal parts around the central axis O of the blade main body 1 to be divided into eight regions, and the density is measured in each region, the method is not limited thereto. That is, the blade main body 1 may be divided into a plurality of regions at a mutually equal angle around the central axis O of the blade main body 1, and the density may be measured in each region. Therefore, the number of equally divided regions is not limited to eight. However, in order to secure the measurement accuracy, it is preferable that the number of equally divided regions is at least 4 or more.

Further, in the cutting blade 10, the warpage amount of the blade main body 1 is equal to or less than 300 μm. It should be noted that the warpage amount of the blade main body 1 is obtained as follows.

Figure 5:
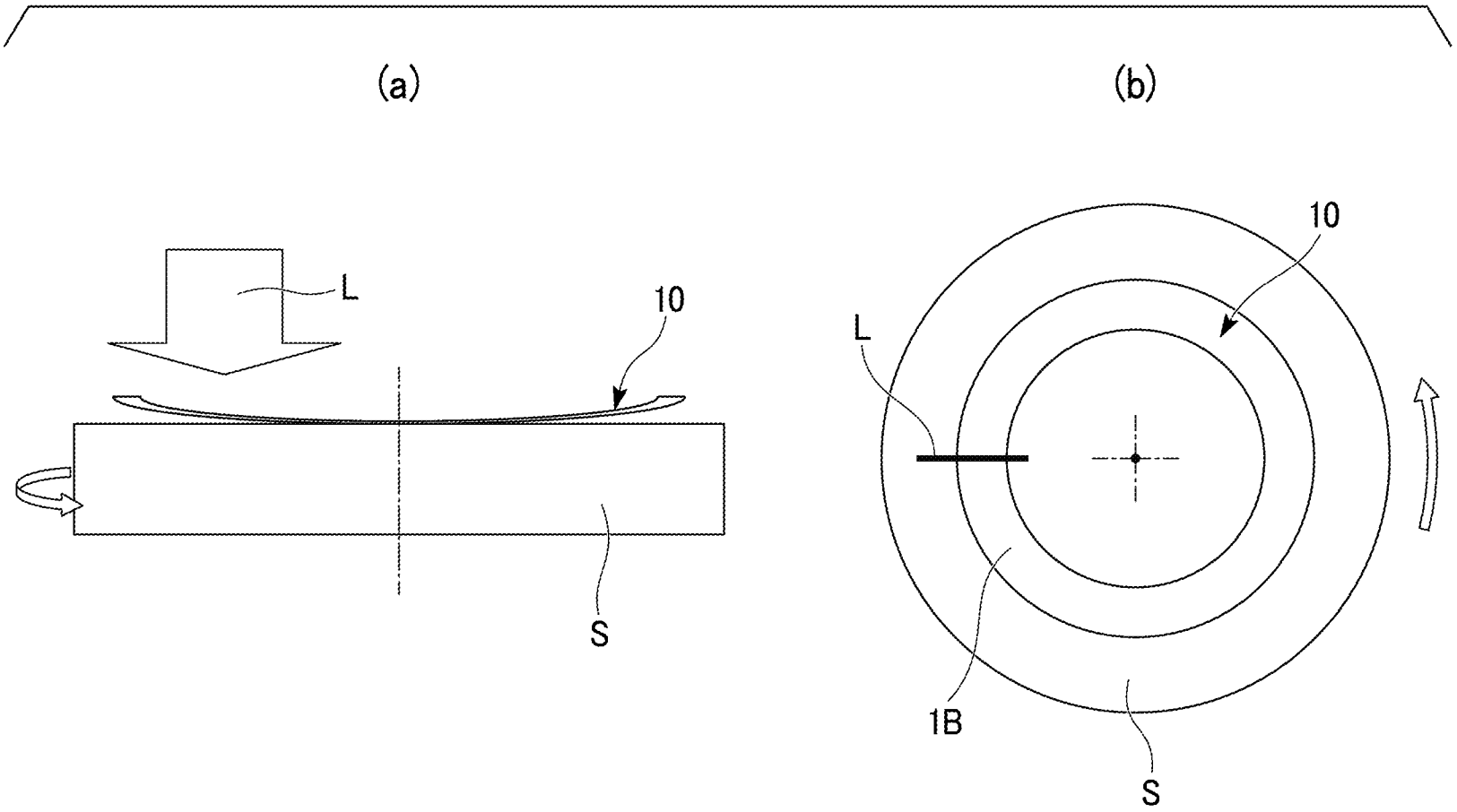
FIG. 5 is a view for explaining a method for measuring a warpage amount of the blade main body.

As shown in FIGS. 5(*a*) and 5(*b*), the cutting blade 10 is placed on the surface plate S. By irradiating the laser beam L of the laser interferometer to the cutting blade 10 while rotating the surface plate S around the central axis, the height of the entire circumference of the cutting blade 10 (the height from the surface plate S) is measured. Then, a value obtained by subtracting the thickness of the blade main body 1 from the maximum value (the height at the position farthest from the surface plate S) among the values obtained by the measurement is defined as the warpage amount. It should be noted that this measurement is performed on both surfaces (both side surfaces 1B, 1B facing the thickness direction) of the blade main body 1, and the larger numerical value is adopted.

Further, in the cutting blade 10, the flatness of the blade main body 1 is equal to or less than 20 μm. It should be noted that the flatness of the blade main body 1 is obtained as follows.

The blade main body 1 is divided into a plurality of regions at a mutually equal angle around the central axis O of the blade main body 1 (for example, eight regions obtained by dividing the blade main body 1 into eight equal parts around the central axis O). Then, in each region, the thickness of the blade main body 1 is measured with a micrometer or the like. The maximum difference in the variation of measurement values (the difference between the maximum value and the minimum value of the thickness) is taken as the flatness.

It should be noted that the blade main body 1 may be divided into a plurality of regions at a mutually equal angle around the central axis O of the blade main body 1, and the thickness may be measured in each region. Therefore, the number of equally divided regions is not limited to eight. However, in order to secure the measurement accuracy, it is preferable that the number of equally divided regions is at least 4 or more.

Next, a method for manufacturing the above-mentioned cutting blade 10 will be described with reference to FIG. 6.

The method for manufacturing the cutting blade 10 of the present embodiment includes: a mixing step of adding a liquid dispersion medium DM to a mixed powder MP containing a resin powder of a thermocompression-bondable resin, abrasive grains 3 and fibrous fillers 5; a compression step of cold pressing the mixed powder MP to which the dispersion medium DM has been added in a forming die to form an original plate 11 of a blade main body 1; a sintering step of hot pressing and sintering the original plate 11; and a finishing step of adjusting the shapes of the outer circumference and the inner circumference of the blade main body 1 obtained by sintering the original plate 11.

Figure 6:
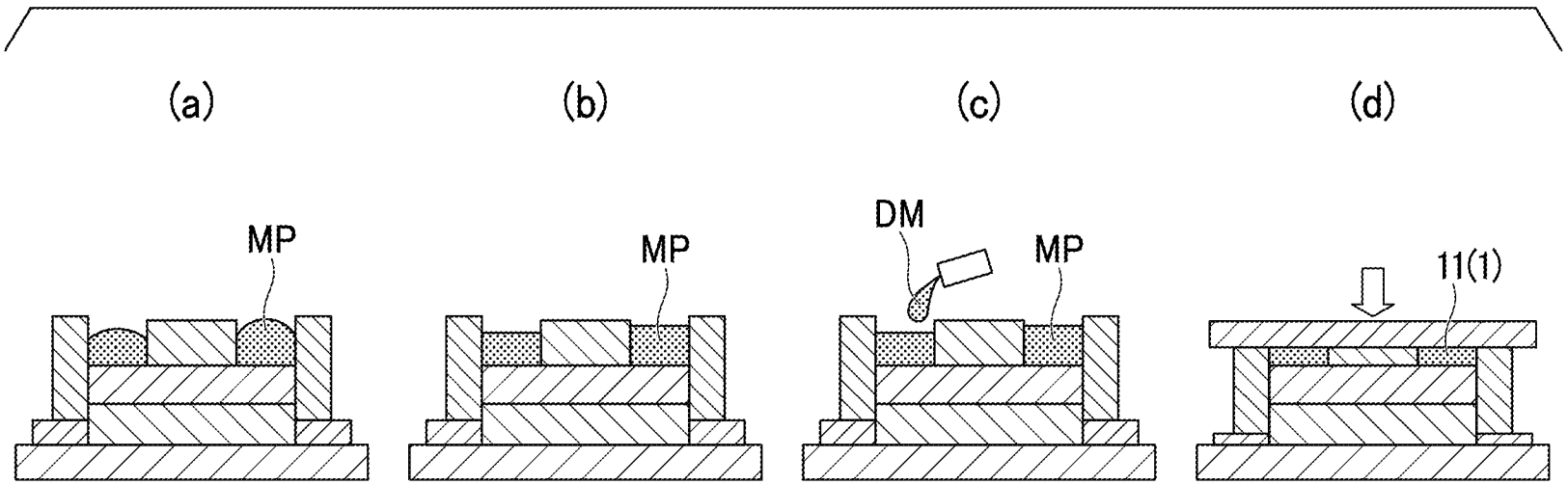
FIG. 6 is a view for explaining a method for manufacturing a cutting blade according to one embodiment of the present invention.

The mixing step includes: a step of filling a forming die with a mixed powder MP containing a resin powder of a thermocompression-bondable resin, abrasive grains 3 and fibrous fillers 5, as shown in FIG. 6(*a*); a step of flattening the surface of the mixed powder MP filled in the forming die, as shown in FIG. 6(*b*); and a step of dropwise adding a liquid dispersion medium DM onto the mixed powder MP whose surface has been flattened, as shown in FIG. 6(*c*).

In the step of flattening the surface of the mixed powder MP, the entire surface (upper surface) of the mixed powder MP is smoothed to a uniform height by manual operation, machine, or the like. Further, in the step of dropwise adding the dispersion medium DM to the mixed powder MP, the dispersion medium DM is uniformly dropped onto the entire surface of the mixed powder MP.

It should be noted that as the "dispersion medium DM" referred to in the present embodiment, for example, chlorofluorocarbon (CFC) substitutes such as a fluorine-based inert liquid or the like can be used. In addition, as the dispersion medium DM, it is preferable to use a liquid having a kinematic viscosity of 2.3 $mm^2/s$ or less (2.3 cSt or less).

It should be noted that the term "kinematic viscosity" used in the present embodiment is a kinematic viscosity required at the time of cold pressing in the compression step described later, and refers to, for example, the kinematic viscosity of a liquid at 25° C.

Specifically, as a substance name used for the dispersion medium DM, for example, tetradecafluorohexane, perfluorocarbonate (C5 to C9) and the like can be mentioned.

More specifically, the following products or the like can be used as the dispersion medium DM.

3M Company: FLUORINERT (registered trademark) FC 72: kinematic viscosity 0.4 cSt 3M Company: FLUORINERT (registered trademark) FC 84: kinematic viscosity 0.55 cSt 3M Company: FLUORINERT (registered trademark) FC 3283: kinematic viscosity 0.82 cSt 3M Company: FLUORINERT (registered trademark) FC 40: kinematic viscosity 2.2 cSt It should be noted that as described in JIS Z 8803: 2011, the unit "cSt" for kinematic viscosity is in a relationship represented by the formula: 1 cSt=1 $mm^2/s$.

Further, in a premixing step (step of mixing in advance) which is a step prior to the above mixing step, the mixed powder MP is produced by mixing in advance the resin powder composed of a thermocompression-bondable resin, the abrasive grains 3 and the fibrous fillers 5. That is, in the premixing step, the resin powder of the thermocompression-bondable resin, the abrasive grains 3 and the fibrous fillers 5 are mixed in advance to prepare a mixed powder MP, and the liquid dispersion medium DM is mixed with the mixed powder MP in the subsequent mixing step.

In the compression step, as shown in FIG. 6(*d*), the mixed powder MP to which the dispersion medium DM has been added through the mixing step is cold compressed (cold pressed) in the forming die.

It should be noted that the term "cold press" as used in the present embodiment refers to, for example, a compression process at normal temperature, and more specifically, a compression process at a temperature lower than the temperature at which thermocompression bonding of the resin powder occurs. More specifically, the temperature for the cold pressing process is preferably equal to or less than 60° C., and the pressure for the cold pressing process is preferably equal to or less than 100 MPa. By this cold pressing process, most of the dispersion medium DM contained in the mixed powder MP is caused to flow out from the mixed powder MP to the outside.

Further, in the present embodiment, a metal mold is used as the forming die. However, at least in the steps prior to the compression step, a mold made of a material other than a metal material may be used as the forming die.

In the sintering step, the original plate 11 of the blade main body 1 is compressed (hot pressed) while being heated in the forming die.

It should be noted that the term "hot press" as used in the present embodiment refers to a compression process in a temperature range where thermocompression bonding of the resin powder is performed.

Preferred conditions for the hot pressing process are shown below.

(a) When the thermocompression-bondable resin is a phenol resin, the hot pressing temperature is from 180 to 220° C., the pressure is equal to or more than 10 MPa, and the hot pressing time is equal to or more than 25 minutes.

(b) When the thermocompression-bondable resin is a polyimide resin, the hot pressing temperature is equal to or more than 350° C., the pressure is equal to or more than 50 MPa, and the hot pressing time is equal to or more than 25 minutes.

(c) When the thermocompression-bondable resin is polybenzimidazole, the hot pressing temperature is equal to or more than 400° C., the pressure is equal to or more than 50 MPa, and the hot pressing time is equal to or more than 25 minutes.

More specifically, for example, when the thermocompression-bondable resin is a polyimide resin, the original plate 11 is hot-pressed under conditions where a temperature of a hot plate of the forming die is 330° C., a metal mold temperature is 320° C. or more, a time is 30 minutes, and a pressure is 10 tons.

Further, after hot pressing, it is preferable to carry out a heat treatment in a heating furnace at a temperature of 180 to 450° C. for 8 hours or more to complete the sintering of the blade main body 1. The heat treatment is preferably performed in a state (no-load state) in which no load is applied to the original plate 11. The duration (time) of the heat treatment is preferably 24 hours or less. When the thermocompression-bondable resin is a phenol resin, the temperature of the heat treatment is preferably from 180 to 220° C. When the thermocompression-bondable resin is a polyimide resin or polybenzimidazole, the temperature of the heat treatment is preferably from 350 to 450° C.

In the finishing step, the blade main body 1 obtained by heat curing (thermally curing) the original plate 11 through the sintering step is subjected to finishing processing by cutting or grinding the outer circumference and the inner circumference so as to obtain outer and inner diameters with predetermined sizes. Further, in this finishing step, regarding the outer peripheral edge of the blade main body 1, the cutting edge 1A may be subjected to a dressing treatment.

As a result, the cutting blade 10 of the present embodiment can be obtained.

In the method for manufacturing the cutting blade 10 of the present embodiment described above, the liquid dispersion medium DM is added to the mixed powder MP containing the resin powder of a thermocompression-bondable resin, the abrasive grains 3 and the fibrous fillers 5 to obtain a mixture, and the mixture is cold pressed in a forming die such as a metal mold or the like. Therefore, at the time of this cold pressing process, the dispersion medium DM enters the gaps between the powder particles of the mixed powder MP, and it is possible to promote the powder flow utilizing the liquid flow.

That is, in the present embodiment, by applying pressure in a forming die to a mixture of the mixed powder MP and the dispersion medium DM in the compression step, the dispersion medium DM acts like a lubricant, so that the resin powder, the abrasive grains 3 and the fibrous fillers 5 uniformly diffuse in the forming die. For this reason, variation in the density of the original plate 11 of the blade main body 1 to be produced is remarkably suppressed to a low level, and the fibrous fillers 5 are uniformly dispersed in the original plate 11.

At this time, although the fibrous fillers 5 face toward a direction intersecting with the thickness direction of the blade main body 1 (that is, any one direction of all directions (360 degrees) in a plane substantially perpendicular to the central axis O of the blade main body 1), the fibrous fillers 5 are not oriented in a certain direction, and the fibrous fillers 5 are brought into a non-oriented dispersed state having no regularity in orientation (that is, randomly oriented). In other words, since a plurality of fibrous fillers 5 are randomly oriented, they are substantially oriented and dispersed in all directions (360 degrees).

It should be noted that during this compression step, since the cold pressing (cold compression) is performed, thermocompression bonding of the resin powder does not proceed and the fluidity of the resin powder is secured in a stable manner.

Then, the original plate 11 of this blade main body 1 is hot pressed and sintered. As described above, since variation in the density of the original plate 11 is suppressed to a low level, the occurrence of sink marks or the like in the blade main body 1 at the time of sintering can be suppressed. As a result, it is possible to manufacture the blade main body 1 in which warpage and flatness are suppressed to low levels.

Further, since the fibrous fillers 5 are uniformly dispersed from the time of molding the original plate 11, even in the blade main body 1 obtained by sintering the original plate 11, the fibrous fillers 5 are uniformly dispersed in the circumferential direction and the radial direction of the blade. Therefore, it is possible to obtain an excellent cutting blade 10 having no variation in strength. More specifically, as described above, since the fibrous fillers 5 are randomly oriented in an unspecified direction (all directions (360 degrees)) in a plane substantially perpendicular to the central axis O of the blade main body 1 without being oriented in a certain direction, the fibrous fillers 5 function like aggregates and the strength is uniformly increased in the entire blade circumferential direction.

In addition, since the fibrous fillers 5 are uniformly dispersed in random orientation in the blade main body 1, the following actions and effects can also be obtained.

Improvement of wear resistance.

Suppression of blade thinning.

Moderate self-sharpening action.

Improvement of toughness.

Improvement of heat resistance.

That is, since the fibrous fillers 5 are uniformly dispersed in the blade main body 1 in random orientation, the blade main body 1 does not easily wear at predetermined portions in the circumferential direction, and the wear progresses uniformly over the entire circumferential direction. As a result, the abrasion amount of the blade as a whole is also suppressed, and the wear resistance is improved. In addition, since the wear resistance is improved, the tool life is prolonged.

Further, the fibrous fillers 5 are randomly oriented in a plane substantially perpendicular to the central axis O of the blade main body 1. Therefore, with respect to both side surfaces (front and back surfaces of the blade) 1B, 1B facing the thickness direction of the blade main body 1, for example, the circumferential surface and the longitudinal cross section (cross section along the extending direction of the filler 5) of the fibrous filler 5 having an elongated columnar shape are exposed, so that exposure of end surfaces facing the extending direction of the fibrous filler 5 and the transverse cross section (cross section perpendicular to the extending direction of the filler 5) can be suppressed. On the other hand, with respect to the outer circumferential surface facing outward in the radial direction of the blade main body 1, it varies in that some of the fibrous fillers 5 expose their circumferential surfaces and longitudinal cross sections, while some fibrous fillers expose their end surfaces and transverse cross sections.

Therefore, the ratio of the exposed area of the fibrous fillers 5 per unit area of the outer surface of the blade with respect to the both side surfaces 1B, 1B of the blade main body 1 becomes large. In comparison with this, the ratio of the exposed area of the fibrous fillers 5 per unit area of the outer surface of the blade with respect to the outer circumferential surface of the blade main body 1 becomes small. That is, with respect to the exposed area of the fibrous fillers 5 per unit area of the outer surface of the blade, the exposed area of the fibrous fillers 5 on both side surfaces 1B, 1B becomes larger than the exposed area of the fibrous fillers 5 on the outer circumferential surface of the blade main body 1. For this reason, on the outer circumferential surface of the blade main body 1, it is possible to appropriately allow wear to proceed and to maintain the sharpness of the cutting edge 1A satisfactorily (it is possible to promote the self-sharpening action). Further, on both side surfaces 1B, 1B of the blade main body 1, it is possible to suppress the progress of wear and to suppress the blade thinning. Therefore, in the cut surface formed on the workpiece by the cutting process, defects such as inclinations due to the blade thinning hardly occur, and the quality of the cutting process is markedly enhanced.

Further, in the present embodiment, the blade strength is improved by uniform dispersion and random orientation of the fibrous fillers 5. For this reason, for example, compared with a case where the blade strength is to be enhanced by simply using a particulate fillers having high hardness without using the fibrous fillers 5 which is unlike the present embodiment, it is possible to promote a moderate self-sharpening action in the present embodiment.

That is, when attempting to enhance the blade strength by using the conventional particulate fillers, a characteristic orientation cannot be imparted to the particulate fillers; and therefore, a method of simply increasing the hardness of the particulate filler is adopted. However, as the hardness of the particulate fillers increases, the holding power of the abrasive grains 3 becomes too high at the cutting edge 1A; and thereby, it becomes difficult to form a new blade (the self-sharpening action is reduced). For this reason, the sharpness cannot be maintained satisfactorily.

On the other hand, if the fibrous fillers 5 are used as is the case with the present embodiment, the blade strength can be increased without increasing the hardness of the fillers; and therefore, it is possible to promote a moderate self-sharpening action and to maintain the sharpness satisfactorily.

In addition, since the fibrous fillers 5 are uniformly dispersed and randomly oriented inside the blade main body 1, these fibrous fillers 5 act like aggregates, and the toughness of the blade main body 1 is improved. For this reason, the strength of the cutting blade 10 is increased while the impact resistance is also improved, and in particular, rigidity is sufficiently secured even in the cutting process during high speed rotation, and high-quality cutting precision can be maintained.

Further, since the fibrous fillers 5 are uniformly dispersed and randomly oriented, it is possible to improve the thermal conductivity between the fibrous fillers 5 inside the blade main body 1. For this reason, for example, in the case of using metal fibers, carbon fibers or the like having a high thermal conductivity as the fibrous fibers 5, the frictional heat generated at the outer peripheral edge portion (cutting edge 1A) of the blade main body 1 during the cutting process is thermally dissipated in the blade at an early stage through the fibrous fillers 5, and the cooling efficiency is also improved; and thereby, the heat resistance of the cutting blade 10 is improved.

It should be noted that most of the dispersion medium DM added to the mixed powder MP before cold pressing flows out from the mixed powder MP (the original plate 11 of the blade main body 1) at the time of cold pressing and is removed. Further, the dispersion medium DM remaining on the original plate 11 of the blade main body 1 after cold pressing can be removed from the blade main body 1, for example, by volatilization before hot pressing in the sintering step. At this time, since the dispersion medium DM is present in a slight space between the powder particles, formation of the blade main body 1 in a porous form by volatilization of the dispersion medium DM is prevented. Further, in this case, since the dispersion medium DM does not remain in the blade main body 1 produced through the sintering step, the performance of the blade main body 1 is not adversely affected by the dispersion medium DM.

More specifically, it is preferable that the timing at which the dispersion medium DM is volatilized in the sintering step is before the start of the thermocompression bonding of the resin powder by hot pressing. In other words, it is preferable that all of the dispersion medium DM is volatilized before conducting the hot pressing process (before the sintering step). As a result, the space in which the dispersion medium DM has been present between the powder particles is occupied (replaced) by the resin phase 2, so that traces of the dispersion medium DM are not left in the blade main body 1 after sintering. Therefore, the dispersion medium DM and its traces do not adversely affect the performance of the blade main body 1.

More specifically, in the cutting blade 10 manufactured according to the present embodiment, the blade main body 1 is divided into a plurality of regions at a mutually equal angle around the central axis O of the blade main body 1 (in the example of the present embodiment, four regions obtained by dividing the blade main body 1 into four equal parts around the central axis O). The content rate of the fibrous fillers 5 obtained in each region can be suppressed to 90 to 110% with respect to the overall content rate of the fibrous fillers 5 in the entire blade main body 1.

In other words, the fibrous fillers 5 are uniformly contained in each region of the blade main body 1, and the fibrous fillers 5 are uniformly dispersed over the entire region of the blade main body 1. This is because, as described above, the fibrous fillers 5 have already been uniformly dispersed over the entire blade in the original plate 11 of the blade main body 1 that has undergone the compression step by cold pressing. Therefore, the manufactured blade main body 1 has excellent rigidity with no variation in strength over the entire blade.

In addition, in the cutting blade 10 manufactured according to the present embodiment, the blade main body 1 is divided into a plurality of regions at a mutually equal angle around the central axis O of the blade main body 1 (in the example of the present embodiment, eight regions obtained by dividing the blade main body 1 into eight equal parts around the central axis O), and an average value of the densities measured in the regions is taken as the average density. The density measured in each region can be suppressed to 90 to 110% with respect to this average density. In other words, the density difference (variation in density) is suppressed to a low level over the entire region of the blade main body 1. This is because, as described above, the density difference has already been suppressed to a low level in the original plate 11 of the blade main body 1 that has undergone the compression step by cold pressing. Therefore, warpage and flatness of the produced blade main body 1 are suppressed to low levels.

More specifically, in the cutting blade 10 manufactured according to the present embodiment, the warpage amount of the blade main body 1 can be suppressed to 300 μm or less. Further, the flatness of the blade main body 1 can be suppressed to 20 μm or less.

In addition, the flatness of both side surfaces 1B, 1B facing the thickness direction of the blade main body 1 obtained after sintering is suppressed to a low level as described above. Therefore, even in a field of application where high-quality cutting precision is particularly required, it is possible to satisfy the expected flatness without flattening both side surfaces 1B, 1B of the blade main body 1 by a lapping treatment.

As described above, since the warpage and the flatness of the blade main body 1 are suppressed to low levels, the following actions and effects can be obtained when a workpiece is cut with the cutting blade 10.

That is, since the deflection of the cutting blade 10 in the thickness direction is suppressed, the cutting width is suppressed to a small value, and the product yield of the workpiece can be improved. In addition, a force from the cutting blade 10 to the workpiece in the cutting width direction (the width direction of the cutting line formed on the workpiece by the cutting process) hardly acts. For this reason, the cutting blade 10 smoothly cuts into the workpiece, and the occurrence of burrs, chipping or the like on the cut surface is prevented. Therefore, the quality of the electronic material parts (products) and the like obtained by dividing the workpiece into individual pieces can be stably increased.

Furthermore, since it is unnecessary to perform a lapping treatment on the blade surface, there is no possibility that the abrasive grains 3 protrude from the resin phase 2 by this lapping treatment. That is, in the present embodiment, the blade main body 1 obtained through the sintering step includes the abrasive grains 3 disposed further to the inside than the side surface 1B of the blade main body 1 in the thickness direction, and there are no abrasive grains 3 protruding outward in the thickness direction from the side surface 1B. For this reason, it is possible to remarkably suppress problems such as the abrasive grains 3 protruding from the side surface 1B of the blade main body 1 to roughen the cut surface of the workpiece and lower the processing quality (generate burrs, chipping or the like) during the cutting process. Therefore, the cutting precision can be particularly enhanced by this effect that no abrasive grains 3 protrude from the side surface 1B in conjunction with the effect that the flatness can be suppressed to a low level as described above.

More specifically, conventionally, particularly in the case of attempting to reduce the thickness of the blade main body to 1.1 mm or less, it has been essential to carry out a lapping treatment in order to suppress the flatness of the blade surface to a small value and to reduce the thickness of the blade main body down to the expected thickness (thin it down to the desired thickness). For this reason, it was impossible to prevent the abrasive grains from protruding from the side surface of the blade main body.

On the other hand, according to the present embodiment, even if the thickness of the blade main body 1 is reduced to 1.1 mm or less, the flatness has already been suppressed to a small value after sintering; and therefore, the lapping treatment is unnecessary. As a result, it is possible to reliably prevent the abrasive grains 3 from protruding from the side surface 1B of the blade main body 1. That is, both side surfaces 1B, 1B of the blade main body 1 that have undergone the sintering step are in a state where the surface is formed flat by the pressing process and there is no protrusion of the abrasive grains 3. For this reason, by omitting the lapping treatment, it is possible to reduce the number of abrasive grains 3 protruding from the blade surface to zero.

Furthermore, since it is unnecessary to perform a lapping treatment, not only the production is facilitated, but also it becomes unnecessary to form the blade main body with a large thickness in advance in anticipation of the lapping treatment as in the prior art, and the material cost is reduced.

Further, in the prior art, the reaction force received by the cutting blade 10 when cutting the workpiece acted unevenly against the portion having a large amount of warpage. In the present embodiment, the warpage and the flatness of the blade main body 1 are suppressed to low levels; and thereby, the above problems are prevented. In other words, according to the present embodiment, since the above reaction force is more likely to act uniformly over the entire circumference in the circumferential direction of the cutting blade 10, and the application of a large load to a predetermined portion is prevented, the tool life of the cutting blade 10 is prolonged.

Figure 8:
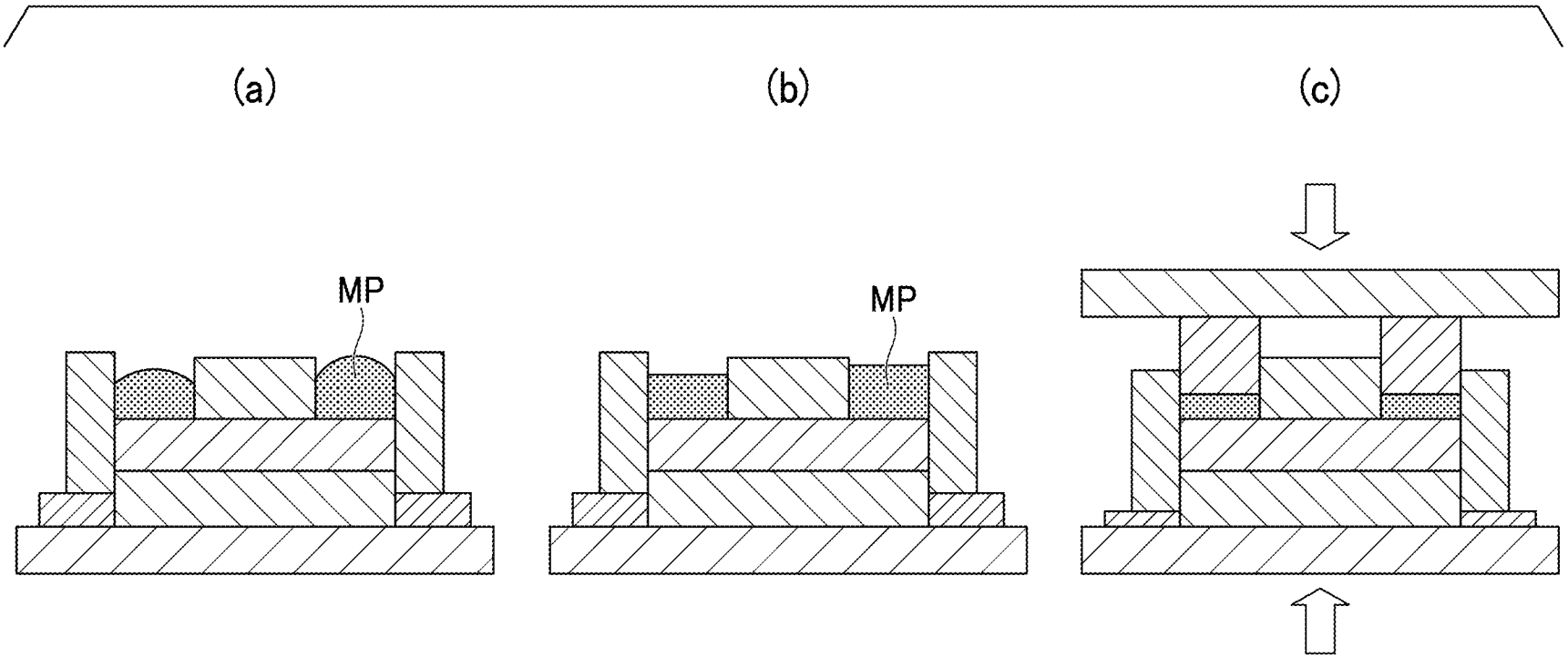
FIG. 8 is a view for explaining a method for manufacturing a conventional cutting blade.

Further, in manufacturing the cutting blade 10 in which the cutting precision is markedly enhanced as described above, in comparison with the conventional manufacturing method shown in FIGS. 8(*a*) to 8(*c*), a particularly complicated manufacturing process is not used in the present embodiment. More specifically, in the present embodiment, by passing through a simple process of cold pressing the mixed powder MP to which the dispersion medium DM has been added in a forming die, variation in the density of the blade main body 1 (original plate 11) is suppressed, while the fibrous fillers 5 are uniformly dispersed and the fibrous fillers 5 are randomly oriented. As a result, since the above-mentioned excellent actions and effects can be achieved, it is easy to manufacture the cutting blade 10.

As described above, according to the method for manufacturing the cutting blade 10 of the present embodiment, it is possible to include the resin phase 2 composed of a thermocompression-bondable resin, and the fibrous fillers 5 can be uniformly dispersed without orienting the fibrous fillers 5 in a certain direction inside the blade main body 1. As a result, it is possible to easily manufacture the cutting blade 10 in which the strength is uniformly increased in the entire blade circumferential direction.

Further, according to the cutting blade 10 of the present embodiment, since the strength is uniformly increased in the entire circumferential direction of the blade, the cutting process can be stably performed at high speed rotation.

In addition, in the method for manufacturing the cutting blade 10 of the present embodiment, the mixing step includes: a step of filling a forming die with the mixed powder MP containing the resin powder of a thermocompression-bondable resin, the abrasive grains 3 and the fibrous fillers 5; a step of flattening the surface of the mixed powder MP; and a step of dropwise adding a liquid dispersion medium DM onto the mixed powder MP whose surface has been flattened. Therefore, the following actions and effects are achieved.

That is, in this case, since the mixing step includes the step of flattening the surface of the mixed powder MP filled in the forming die, the flow amount of the mixed powder MP until it diffuses uniformly into the forming die in the compression step which is a subsequent step of this mixing step can be suppressed to a low level. For this reason, the following actions and effects are achieved more stably.

The above-described effect that variation in the density of the original plate 11 of the blade main body 1 can be suppressed to a low level.

The effect that the fibrous fillers 5 are uniformly dispersed in the interior of the original plate 11 while the fibrous fillers 5 are randomly oriented without being oriented in a certain direction.

In addition, since the mixing step includes the step of dropwise adding the dispersion medium DM to the mixed powder MP whose surface has been flattened, the dispersion medium DM is more easily mixed uniformly with the mixed powder MP. In other words, since the dispersion medium DM easily spreads all over the mixed powder MP as a whole and increases the affinity therewith, the powder flow of the mixed powder MP making use of (utilizing) the liquid flow of the dispersion medium DM is uniformly distributed over the entire interior of the forming die in the compression step which is a subsequent step of this mixing step. Therefore, the following actions and effects are achieved more stably.

The above-described effect that variation in the density of the original plate 11 of the blade main body 1 can be suppressed to a low level.

The effect that the fibrous fillers 5 are uniformly dispersed in the interior of the original plate 11 while the fibrous fillers 5 are randomly oriented without being oriented in a certain direction.

Further, in the method for manufacturing the cutting blade 10 of the present embodiment, since a liquid having a kinematic viscosity of 2.3 $mm^2/s$ or less is used as the dispersion medium DM, the dispersion medium DM spreads between the powder particles of the mixed powder MP, and increases the affinity with the powder particles of the mixed powder MP to facilitate the liquid flow over a wide range, and the dispersion medium DM also effectively functions as a lubricant to promote the powder flow of the mixed powder MP. As a result, in the compression step, the effect of uniformly diffusing the mixed powder MP into the forming die can be obtained more remarkably.

More specifically, in the case where the kinematic viscosity of the dispersion medium DM is equal to or less than 2.3 $mm^2/s$, the warpage and flatness of the blade main body 1 obtained after sintering are remarkably suppressed to low levels, and the strength of the entire blade is remarkably increased.

In addition, in the cutting blade 10 of the present embodiment, since the overall content rate of the fibrous fillers 5 in the entire blade main body 1 is from 20 to 60 vol %, it is possible to reliably achieve the actions and effects brought about by the fibrous fillers 5 as described above, while preventing reduction in the blade rigidity due to inclusion of an excessive amount of the fibrous fillers 5.

That is, since the overall content rate of the fibrous fillers 5 is equal to or more than 20 vol %, the above-described actions and effects due to the dispersion of the fibrous fillers 5 in the blade main body 1 can be reliably obtained. In addition, since the overall content rate of the fibrous fillers 5 is equal to or less than 60 vol %, it is possible to suppress the excessive reduction of the resin phase 2 serving as a bonding agent interposed between the fibrous fillers 5; and thereby, the function of the resin phase 2 is stabilized.

Further, in the cutting blade 10 of the present embodiment, the blade main body 1 is divided into a plurality of regions at a mutually equal angle around the central axis O of the blade main body 1, and an average value of the densities measured in the regions is taken as the average density. The density measured in each region is from 90 to 110% with respect to the average density.

Further, the warpage amount of the blade main body 1 is equal to or less than 300 μm, and the flatness of the blade main body 1 is equal to or less than 20 μm.

In the cutting blade 10, the density measured in each region is from 90 to 110% with respect to the average density (within ±10% when the average density is taken as 100%), and variation in the density of the blade main body 1 is suppressed to a low level. Therefore, the warpage amount of the blade main body 1 can be suppressed to as low as 300 μm or less. In addition, the flatness of the blade main body 1 can be suppressed to as low as 20 μm or less. For this reason, at the time of manufacturing the cutting blade 10, it is possible to reduce (omit) operations such as a lapping treatment for flattening the blade surfaces (both side surfaces 1B, 1B).

Therefore, while improving the ease of manufacturing the cutting blade 10, the cutting precision by the cutting blade 10 can be remarkably enhanced.

More specifically, in a conventional cutting blade, as described with reference to FIGS. 8(*a*) to 8(*c*), since variation tends to occur in the packing density inside the mixed powder in the forming die at the time of manufacturing the blade, the flatness of the side surface of the blade main body obtained after sintering was, more or less, as large as 100 μm (about 100 μm). For this reason, in the field of application where the cutting precision was particularly required, both side surfaces of the blade main body were subjected to a lapping treatment for planarization. However, even if the resin phase is removed by the lapping treatment, abrasive grains with high hardness tend to remain in a state of being protruded from the side surface, and it was difficult to satisfy the expected flatness.

On the other hand, according to the cutting blade 10 of the present embodiment, since the variation in the packing density inside the mixed powder MP in the forming die can be suppressed to a small value, the flatness of the side surface 1B of the blade main body 1 obtained after sintering can be suppressed to as low as 20 μm or less. Therefore, even in a field of application where the cutting precision is particularly required, it is possible to satisfy the expected flatness without flattening both side surfaces 1B, 1B of the blade main body 1 by a lapping treatment.

Furthermore, since it is unnecessary to subject the blade surface to a lapping treatment, there is no possibility that the abrasive grains 3 protrude from the resin phase 2 by this lapping treatment. In other words, since there are no abrasive grains 3 protruding in the thickness direction on the side surface 1B of the blade main body 1 obtained through the sintering step; and therefore, the cutting precision can be particularly enhanced by this effect that no abrasive grains 3 protrude from the side surface 1B in conjunction with the effect that the flatness can be suppressed to a low level as described above.

Further, in the cutting blade 10 of the present embodiment, the thickness of the blade main body 1 is equal to or less than 1.1 mm.

Since the strength of the cutting blade 10 is increased in the entire region of the blade main body 1 as described above, it is easy to reduce the thickness of the blade main body 1 to 1.1 mm or less while ensuring the rigidity of the blade main body 1.

Therefore, it is possible to more remarkably obtain the effect that the cutting width of the workpiece can be suppressed to a small value to improve the product yield while satisfactorily maintaining the cutting precision.

It should be noted that the present invention is not limited to the above-described embodiments, and various modifications can be made without departing from the features of the present invention.

For example, in the cutting blade 10 of the above-described embodiment, although the blade main body 1 is formed by providing one layer of the resin phase 2 in which the abrasive grains 3 and the fibrous fillers 5 are dispersed, a plurality of layers of such resin phase 2 may be laminated in the thickness direction to form the blade main body 1. In this case, a plurality of the original plates 11 of the blade main body 1 obtained through the compression step are stacked in the thickness direction, and hot pressed and sintered in the sintering step.

In addition, in the above-described embodiment, although the mixing step in the manufacturing method of the cutting blade 10 includes a step of filling the forming die with the mixed powder MP containing the resin powder, the abrasive grains 3 and the fibrous fillers 5, a step of flattening the surface of the mixed powder MP, and a step of dropwise adding the dispersion medium DM onto the mixed powder MP, the present invention is not limited thereto. That is, in the mixing step, for example, the dispersion medium DM may be dropwise added without flattening the surface of the mixed powder MP, or the dispersion medium DM may be dropwise added to the mixed powder MP and then the resulting mixture may be filled into the forming die. However, as described in the above embodiment, in the case where the mixing step includes the above-described three steps, in the original plate 11 of the blade main body 1 that has undergone the compression step which is a subsequent step of this mixing step, the effect that variation in the density can be suppressed to a low level, and that the fibrous fillers 5 are uniformly dispersed can be more remarkably obtained. Therefore, it is preferable that the mixing step includes the above-described three steps.

Further, in the above-described embodiment, although the abrasive grains 3 composed of either diamond or cBN are dispersed in the resin phase 2, the present invention is not limited thereto. That is, particles composed of a hard material other than diamond and cBN may be dispersed in the resin phase 2 as the abrasive grains 3.

In addition, in the above-described embodiment, for example, although a polyimide resin, a certain phenol resin, polybenzimidazole (PBI (registered trademark)) or the like is used as the thermocompression-bondable resin for forming the resin phase 2, the present invention is not limited thereto, and other thermocompression-bondable resins may be used.

Further, the blade main body 1 is divided into a plurality of regions at a mutually equal angle around the central axis O of the blade main body 1, and an average value of the densities measured in the regions is taken as the average density. It is explained that the density measured in each region is from 90 to 110% with respect to the average density. This means that, for example, even if the type of the resin powder serving as the raw material of the resin phase 2 changes and the average density changes, all the density values (the density value of each region) measured in a plurality of regions equally divided around the central axis O are within the range of 90 to 110% with respect to the average density. However, the present invention is not limited to the case where the density measured in each region with respect to the average density falls within the range of 90 to 110%.

Further, the blade main body 1 is divided into a plurality of regions at a mutually equal angle around the central axis O of the blade main body 1, and the content rate of the fibrous fillers 5 in each region is measured. It is explained that the content rate of the fibrous fillers 5 in each region is from 90 to 110% with respect to the overall content rate of the fibrous fillers 5 in the entire blade main body 1. This means that, for example, even if the overall content rate of the fibrous fillers 5 in the entire blade main body 1 varies within the range of 20 to 60 vol % described in the above embodiment, all the content rate values of the fibrous fillers 5 (the content rate value of the fibrous fillers 5 in each region) measured in a plurality of regions equally divided around the central axis O are within the range of 90 to 110% with respect to the overall content rate.

It should be noted that the present invention is not limited to the case where the overall content rate of the fibrous fillers 5 in the entire blade main body 1 falls within the range of 20 to 60 vol %.

Further, in the above-described embodiment, for example, although chlorofluorocarbon (CFC) substitutes such as a fluorine-based inert liquid or the like is used as the dispersion medium DM, the present invention is not limited thereto. That is, the dispersion medium DM may be a CFC substitute other than the fluorine-based inert liquid or a liquid other than the CFC substitute.

In addition, in the above-described embodiment, although it is explained that the cutting blade 10 is used for cutting, for example, an electronic material part which is a composite material including a metal material in a resin, such as QFN or IrDA, as a workpiece, the present invention is not limited thereto. That is, the cutting blade 10 is used for semiconductor devices (electronic material parts), and may also be used in the step of precisely cutting a workpiece including a brittle material (hard brittle material) such as glass, a ceramic, quartz or the like.

In addition, the respective configurations (constituent elements) described in the above embodiments, modifications, explanatory notes and the like may be combined, and additions, omissions, substitutions, and other modifications can be made without departing from the features of the present invention. Further, the present invention is not limited by the embodiments described above, but is limited only by the scope of the claims.

Examples

Hereinafter, the present invention will be described in more detail with reference to examples. However, the present invention is not limited to these examples.

<Confirmation of Variation in Content Rate of Fibrous Fillers>

A cutting blade 10 manufactured by the method for manufacturing the cutting blade 10 described in the above embodiment will be referred to as Example 1, a cutting blade manufactured by the conventional manufacturing method shown in FIGS. 8(*a*) to 8(*c*) will be referred to as Comparative Example 1, and a cutting blade manufactured by the doctor blade method will be referred to as Comparative Example 2. With respect to these three types of cutting blades, those in which the overall content rate of the fibrous fillers in the entire blade main body was 19 vol %, 20 vol %, 30 vol %, 40 vol %, 50 vol %, 60 vol % or 61 vol % were prepared, respectively.

It should be noted that in each of the cutting blades, the blade main body was formed of a resin phase, and the same material (raw material) was used for the resin powder serving as the raw material of the resin phase. More specifically, a polyimide resin which was a thermocompression-bondable resin was used as the resin powder. Further, the same material was also used for the abrasive grains and the fibrous fillers to be dispersed in the resin phase. The content rate of the abrasive grains in the blade main body was set to be equal to each other among the cutting blades.

In manufacturing the cutting blade 10 of Example 1, FLUORINERT (registered trademark) FC 72 (manufactured by 3M Company, kinematic viscosity: 0.4 cSt) was used as the dispersion medium DM.

The dimensions of the blade main body of each cutting blade were as follows.

Outer diameter: φ58 mm

Inner diameter: φ40 mm

Thickness: 1.1 mm

Then, in each of the cutting blades, as shown in FIG. 4, the blade main body was equally divided into four regions around the central axis O of the blade main body, and the content rate of the fibrous fillers was measured in each region. Further, when the overall content rate of the fibrous fillers in the entire blade main body as described above was taken as 100%, ranges within which each content rate of the fibrous fillers measured in the four regions falls, with respect to 100% of the overall content rate of the fibrous fillers, were identified. More specifically, the ratio (percentage) of the content rate of the fibrous fillers in each region with respect to the overall content rate of the fibrous fillers was determined, and the range of variation in the ratio was obtained.

It should be noted that the expressions "when X is taken as 100%, Y is within the range of ±Z %" and "Y is within the range of ±Z % with respect to 100% of X" mean that the ratio of Y with respect to X (Y/X) (percentage) is within the range of (100−Z)% to (100+Z)%. Further, the overall content rate of the fibrous fillers was substantially the same as the designed value (target value).

The measurement results are shown in Table 1 below.

In Table 1, the circle indicates that the content rate of the fibrous fillers in each region was within the range of ±5% with respect to 100% of the overall content rate of the fibrous fillers. The triangular mark indicates that the content rate of the fibrous fillers in each region was within the range of ±15% with respect to 100% of the overall content rate of the fibrous fillers. The x mark (cross mark) indicates that the content rate of the fibrous fillers in each region was outside the range of ±15% with respect to 100% of the overall content rate of the fibrous fillers. More specifically, the x mark indicates that among the content rate values of the fibrous fillers in each region, there was a value outside the range of ±15% with respect to 100% of the overall content rate of the fibrous fillers.

TABLE 1

<Comparison of variation in content rate of fibrous fillers>

| Overall content rate of fibrous fillers | Example 1 | Comparative Example 1 | Comparative Example 2 |
|---|---|---|---|
| 19 vol % | ○ | Δ | Δ |
| 20 vol % | ○ | x | x |
| 30 vol % | ○ | x | x |
| 40 vol % | ○ | x | Molding was not possible |
| 50 vol % | ○ | x | |
| 60 vol % | ○ | x | |
| 61 vol % | ○ | Δ | |

Criteria:

All of the content rate values measured in the regions fell within the range of ±5% with respect to the overall content rate: ○

All of the content rate values measured in the regions fell within the range of ±15% with respect to the overall content rate: Δ

There was a content rate value measured in the region that did not fall within the range of ±15% with respect to the overall content rate: ×

From the results in Table 1, it can be seen that in the cutting blade 10 of Example 1, all of the content rates of the fibrous fillers 5 measured in the regions fell within the range of ±10% (that is, from 90 to 110%) with respect to the overall content rate of 100%. More specifically, all of the content rates of the fibrous fillers 5 in the regions fell within the range of ±5% (that is, 95 to 105%) with respect to the overall content rate of 100%.

On the other hand, in the cutting blades of Comparative Examples 1 and 2, among the content rate values of the fibrous fillers measured in the regions, there was a value outside the range of ±15% (that is, a value of less than 85% or more than 115%) with respect to the overall content rate of 100%, and the variation in the content rate of the fibrous fillers was large. It should be noted that in Comparative Example 2, when the overall content rate of the fibrous fillers was 40 vol % or more, it was not possible to form the sheet body from the slurry, and the molding process could not be performed.

<Abrasion Test>

The cutting blade 10 manufactured by the same manufacturing method as in Example 1 described above will be referred to as Example 2, a cutting blade manufactured by the same manufacturing method as in Comparative Example 1 described above will be referred to as Comparative Example 3 and a cutting blade manufactured by the same manufacturing method as in Comparative Example 2 described above will be referred to as Comparative Example 4. A comparative test of blade abrasion amount was carried out using each cutting blade.

Also in this abrasion test, with respect to each of the cutting blades of Example 2, Comparative Example 3 and Comparative Example 4, those in which the overall content rate of the fibrous fillers in the entire blade main body was 19 vol %, 20 vol %, 30 vol %, 40 vol %, 50 vol %, 60 vol % or 61 vol % were prepared, respectively. It should be noted that in Comparative Example 4, when the overall content rate of the fibrous fillers was 40 vol % or more, it was not possible to form the sheet body from the slurry, and the molding process could not be performed.

The dimensions of the blade main body of each cutting blade were as follows.

Outer diameter: φ58 mm

Inner diameter: φ40 mm

Thickness: 1.1 mm

Further, the specification of SDC 170-100 was adopted for the used blades of Example 2, Comparative Example 3 and Comparative Example 4.

The test conditions were as follows.

Cutting machine used: A-WD 100A, manufactured by Tokyo Seimitsu Co., Ltd.

Spindle rotation speed: 15,000 $m^{-1}$

Cut: 0.8 mm

Feed rate: 100 mm/s

Amount of cooling water: 1.2 L+1.2 L

Dresser plate: A2-2 mm, manufactured by Tokyo Seimitsu Co., Ltd.

Number of grooves: 30 grooves×5 sets

Then, the cutting blade mounted on the cutting machine was rotated, and grooving was performed on the dresser plate to confirm the blade abrasion amount.

The test results are shown in Table 2 below.

TABLE 2

<Comparison of blade abrasion amount>

(μm)

| Overall content rate of fibrous fillers | Example 2 | Comparative Example 3 | Comparative Example 4 |
|---|---|---|---|
| 19 vol % | 358 | 551 | 1003 |
| 20 vol % | 316 | 664 | 982 |
| 30 vol % | 263 | 701 | 1215 |
| 40 vol % | 248 | 857 | Molding was not possible |
| 50 vol % | 312 | 1002 | |
| 60 vol % | 387 | 1213 | |
| 61 vol % | 403 | 1412 | |

From the results in Table 2, it was confirmed that the abrasion amount of each of the cutting blades 10 of Example 2 was all less than 500 μm, the abrasion amount was remarkably suppressed, and the wear resistance was enhanced. In Example 2, the variation in the density of the blade main body 1 was suppressed to a low level, and the fibrous fillers 5 were uniformly dispersed. For this reason, the abrasion amount progressing inward in the radial direction from the outer circumference of the blade was made uniform throughout the circumferential direction. As a result, it is considered that the wear resistance was enhanced because there was no place where wear was allowed to proceed at an early stage, and the progress of abrasion as a whole was also suppressed.

Further, above all, with respect to the cutting blades 10 in which the overall content rate of the fibrous fillers 5 was from 20 to 60 vol %, it was confirmed that the abrasion amount was all less than 400 and excellent wear resistance could be obtained.

On the other hand, in Comparative Examples 3 and 4, the abrasion amounts of the cutting blades all exceeded 550 μM, and the amount of abrasion was large. It should be noted that there was a trend where the blade abrasion amount increased as the overall content rate of the fibrous fillers increased.

<Cutting Test>

The cutting blade 10 manufactured by the same manufacturing method as in the above-described Example 1 will be referred to as Example 3, a cutting blade manufactured by the same manufacturing method as in Comparative Example 1 described above will be referred to as Comparative Example 5 and a cutting blade manufactured by the same manufacturing method as in Comparative Example 2 described above will be referred to as Comparative Example 6. A comparative test of processing quality was carried out using each cutting blade.

Also in this cutting test, with respect to each of the cutting blades of Example 3, Comparative Example 5 and Comparative Example 6, those in which the overall content rate of the fibrous fillers in the entire blade main body was 19 vol %, 20 vol %, 30 vol %, 40 vol %, 50 vol %, 60 vol % or 61 vol % were prepared, respectively. It should be noted that in Comparative Example 6, when the overall content rate of the fibrous fillers was 40 vol % or more, it was not possible to form the sheet body from the slurry, and the molding process could not be performed.

The dimensions of the blade main body of each cutting blade were as follows.

Outer diameter: φ58 mm

Inner diameter: φ40 mm

Thickness: 1.1 mm

Further, the specification of SDC 170-100 was adopted for the used blades of Example 3, Comparative Example 5, and Comparative Example 6.

The test conditions were as follows.

Cutting machine used: A-WD 100A, manufactured by Tokyo Seimitsu Co., Ltd.

Spindle rotation speed: 25,000 $m^{-1}$

Feed rate: 30 mm/s

Tape cut: 0.5 mm

Amount of cooling water: 2.0 L+2.0 L

Workpiece: QFN package (composite material of resin and copper)

Figure 7:
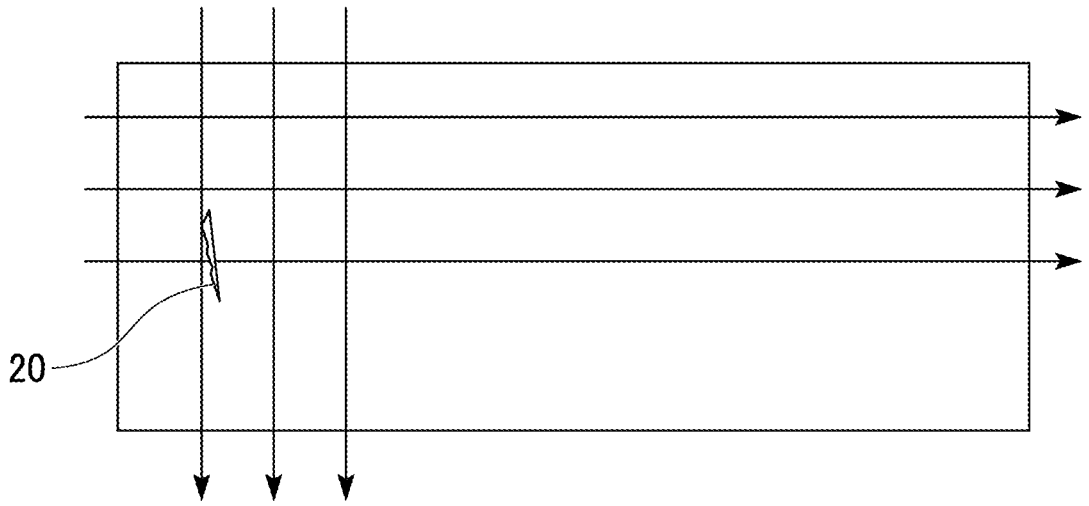
FIG. 7 is a view for explaining burrs generated at the time of cutting a workpiece.

Then, the cutting blade mounted on the cutting machine was rotated to cut the QFN package, and the processing quality was confirmed. The processing quality was assessed by the following method. As shown in FIG. 7, the workpiece was cut (diced) into cubic shapes (the workpiece was cut into a plurality of cubic chips). Next, the length of a burr 20 in a singulated chip was measured. The length of the burr 20 was measured on 10 chips per workpiece. It should be noted that in the case where the burr size was equal to or less than 75 μm, it was assessed that the processing quality of the chip was secured.

The test results are shown in Table 3 below.

TABLE 3

<Comparison of electrode burr size>

(μm)

| Overall content rate of fibrous fillers | Example 3 | Comparative Example 5 | Comparative Example 6 |
|---|---|---|---|
| 19 vol % | 39 | 71 | 129 |
| 20 vol % | 41 | 83 | 134 |
| 30 vol % | 22 | 96 | 161 |
| 40 vol % | 21 | 102 | Molding was not possible |
| 50 vol % | 29 | 99 | |
| 60 vol % | 27 | 132 | |
| 61 vol % | 41 | 171 | |

From the results in Table 3, it became clear that as compared with the burr size of the chip cut by each cutting blade of Comparative Example 5 and the burr size of the chip cut by each cutting blade of Comparative Example 6, the burr size of the chip cut by each cutting blade 10 of Example 3 could be remarkably suppressed to a low level. Further, in Example 3, all the burr sizes were suppressed to 75 μm or less. In Example 3, the variation in the density of the blade main body 1 was suppressed to a low level, and the warpage and the flatness of the blade main body 1 were suppressed to low levels. As a result, it is considered that since the resistance acting on the cut surface of the chip was reduced, the burr size was suppressed remarkably to a small value. In addition, the fibrous fillers 5 were uniformly dispersed in the blade main body 1, and the blade thinning of the cutting edge 1A was suppressed. As a result, it is considered that the burr size was remarkably suppressed to a small value because the processing quality of the cut surface was maintained satisfactorily.

INDUSTRIAL APPLICABILITY

The cutting blade of the present invention is suitably applied to a step of cutting a workpiece such as an electronic material part used for a semiconductor product or the like. Examples of the electronic material parts include a part in which a semiconductor element is mounted on a lead frame and resin-molded, a quad flat non-leaded package (QFN), and an optical transmission module based on the IrDA (Infrared Data Association) standard. Further, the cutting blade of the present invention is also suitably applied to a step of precisely cutting a workpiece including a brittle material (hard brittle material) such as glass, ceramics, quartz or the like.

The method for manufacturing a cutting blade according to the present invention is suitably applied to a step of manufacturing a blade for cutting a workpiece such as the above-mentioned electronic material parts.

REFERENCE SIGNS LIST

1: Blade main body
1A: Cutting edge
2: Resin phase
3: Abrasive grain
5: Fibrous filler
10: Cutting blade
11: Original plate of blade main body
DM: Dispersion medium
MP: Mixed powder
O: Central axis of blade main body

The invention claimed is:

1. A method for manufacturing a cutting blade, the method comprising:

a mixing step of adding a liquid dispersion medium to a mixed powder containing a resin powder of a thermo-compression-bondable resin, abrasive grains and fibrous fillers;

a compression step of cold pressing a mixture of the liquid dispersion medium and the mixed powder in a forming die to form an original plate of a blade main body; and a sintering step of hot pressing and sintering the original plate, wherein the manufactured cutting blade comprises:

a blade main body having a disc shape; and a cutting edge formed on an outer peripheral edge portion of the blade main body, wherein the blade main body comprises:

a resin phase formed of a thermocompression-bondable resin; and abrasive grains and fibrous fillers dispersed in the resin phase, wherein, when the blade main body is divided into a plurality of regions at a mutually equal angle around a central axis of the blade main body, a content rate of the fibrous fillers measured in each region is from 90 to 110% with respect to an overall content rate of the fibrous fillers in the blade main body as a whole, wherein the fibrous fillers are not oriented in a certain direction and randomly oriented in a plane substantially perpendicular to the central axis of the blade main body, and wherein a liquid having a kinematic viscosity of 2.3 $mm^2/s$ or less is used as the liquid dispersion medium.

2. The method for manufacturing a cutting blade according to claim 1, wherein the mixing step comprises:

a step of filling the forming die with the mixed powder containing the resin powder of the thermocompression-bondable resin, the abrasive grains and the fibrous filler;

a step of flattening a surface of the mixed powder; and a step of dropwise adding the liquid dispersion medium onto the mixed powder.

* * * * *